United States Patent [19]

Fajt et al.

[11] 4,382,322

[45] May 10, 1983

[54] AUTOMATED WELDING SYSTEMS AND METHODS

[75] Inventors: John Fajt; James V. Neal, Jr., both of Wynnewood, Okla.

[73] Assignee: Xenell Corporation, Wynnewood, Okla.

[21] Appl. No.: 186,457

[22] Filed: Sep. 12, 1980

[51] Int. Cl.[3] ..... H01J 9/48

[52] U.S. Cl. ..... 228/103; 29/759; 140/71.5; 140/147; 198/389; 228/170; 228/4.5; 445/23; 445/69

[58] Field of Search ..... 29/25.13, 25.19, 25.2, 29/854, 860, 742, 760, 759; 294/115; 198/383, 389, 392; 140/71.5, 147

[56] References Cited

U.S. PATENT DOCUMENTS

| | | | |
|---|---|---|---|
| 477,093 | 6/1892 | Wead | 198/389 |
| 1,646,258 | 10/1927 | Raus et al. | 140/71.5 |
| 1,861,271 | 5/1932 | Herre | 140/71.5 |
| 2,137,181 | 11/1938 | Quackenbush | 140/212 X |
| 2,379,135 | 6/1945 | Ekstedt et al. | 140/71.5 |
| 2,449,505 | 9/1948 | Pityo et al. | 219/56.1 |
| 2,493,560 | 1/1950 | Vasselli | 140/147 X |
| 2,561,151 | 7/1951 | Stoffel | 29/25.13 X |
| 2,605,537 | 8/1952 | Pityo et al. | 228/5.1 |
| 2,606,268 | 8/1952 | Pityo et al. | 219/107 |
| 2,644,069 | 6/1953 | Pityo | 219/56.1 |
| 2,734,119 | 2/1956 | Pityo | 219/107 |
| 2,749,420 | 6/1956 | Pityo | 140/71 R X |
| 2,784,297 | 3/1957 | Pityo | 219/107 X |
| 2,798,514 | 7/1957 | Mullan | 140/71.5 |
| 2,846,561 | 8/1958 | Pityo | 219/79 |
| 2,915,616 | 12/1959 | Griffin | 219/79 |
| 2,916,056 | 12/1959 | O'Brien et al. | 140/71.5 |
| 2,936,797 | 5/1960 | Mullan et al. | 140/71.5 |
| 3,003,051 | 10/1961 | Kulicke, Jr. et al. | 219/56.1 |
| 3,005,900 | 10/1961 | Pityo | 219/79 |
| 3,045,739 | 7/1962 | Fyfe et al. | 72/70 |
| 3,059,321 | 10/1962 | Pityo | 140/71 R X |
| 3,071,166 | 1/1963 | Gutbier | 140/147 X |
| 3,075,562 | 1/1963 | Jankowski | 140/147 |
| 3,079,958 | 3/1963 | Helda | 140/147 |
| 3,101,866 | 8/1963 | Anderson | 221/93 |
| 3,106,945 | 10/1963 | Wright et al. | 140/147 |
| 3,144,889 | 8/1964 | Cole | 140/147 X |
| 3,195,584 | 7/1965 | Zimmerman et al. | 140/147 |
| 3,220,443 | 11/1965 | Smith et al. | 140/147 |
| 3,225,797 | 12/1965 | Stoody | 140/147 |
| 3,294,948 | 12/1966 | Fegley et al. | 219/56.1 |
| 3,297,130 | 1/1967 | Greck | 198/383 |
| 3,300,617 | 1/1967 | Buck et al. | 219/56.22 |
| 3,319,668 | 5/1967 | Shambelan | 140/147 |
| 3,321,606 | 5/1967 | Cropp et al. | 219/79 |
| 3,321,825 | 5/1967 | Cooke | 140/147 X |
| 3,344,816 | 10/1967 | Zemek | 140/147 |
| 3,352,331 | 11/1967 | Swyt | 140/147 |
| 3,365,048 | 1/1968 | Ehrlich et al. | 198/390 |
| 3,396,758 | 8/1968 | Hall | 140/140 X |
| 3,479,712 | 11/1969 | Pityo | 29/38 |
| 3,517,157 | 6/1970 | Best et al. | 219/79 X |
| 3,520,336 | 7/1970 | Zemek | 140/147 |
| 3,537,276 | 11/1970 | Pityo | 65/59.23 |
| 3,542,087 | 11/1970 | Fegley | 140/147 |
| 3,612,254 | 10/1971 | Wideman | 294/115 X |
| 3,687,263 | 8/1972 | Randrup | 198/383 |
| 3,778,584 | 12/1973 | Fajt et al. | 219/101 |
| 3,815,730 | 6/1974 | Zwiep et al. | 198/389 |
| 3,935,773 | 2/1976 | Daebler | 83/331 |
| 4,002,191 | 1/1977 | Lorenzini | 140/147 |
| 4,094,410 | 6/1978 | Fegley et al. | 140/147 X |

FOREIGN PATENT DOCUMENTS

| | | | |
|---|---|---|---|
| 52-29078 | 3/1977 | Japan | 198/389 |

OTHER PUBLICATIONS

Publication of Kahle Engineering Company of Union City, New Jersey, Machine Number 4318, Neon Glow Lamp Production Machine.

Publication of Kahle Engineering Company of Union City, New Jersey, Brochure No. 6903, Entitled "KAHLE Specialists in Automation for all Industries."

Publication of Kahle Engineering Company of Union City, New Jersey, Bulletin REP 70.

Publication of Kahle Engineering Company of Union City, New Jersey, Reprint from AUTOMATION, Sep. 1971, Entitled "Combining Processing and Assembly Operations", by Carl A. Napor.

*Primary Examiner*—Kenneth J. Ramsey

*Attorney, Agent, or Firm*—Laney, Dougherty, Hessin & Beavers

[57] ABSTRACT

An automated welding system takes initially randomly oriented negative glow lamps and welds a resistor to each lamp. Lead wires are trimmed to desired lengths and the physical strength of the weld between the lamp and the resistor is tested.

57 Claims, 51 Drawing Figures

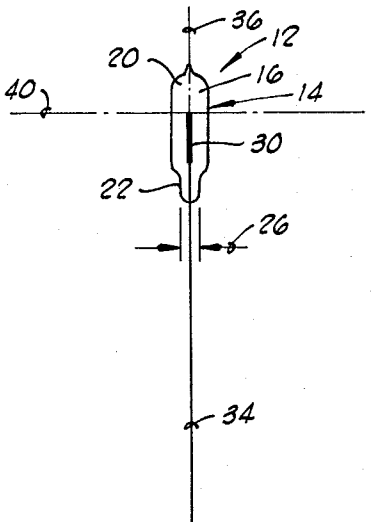
FIG. 7
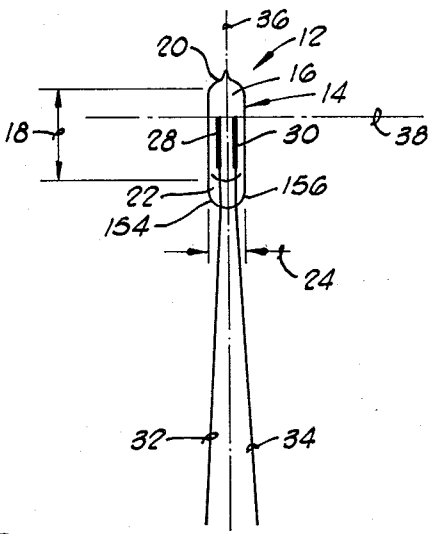
FIG. 8
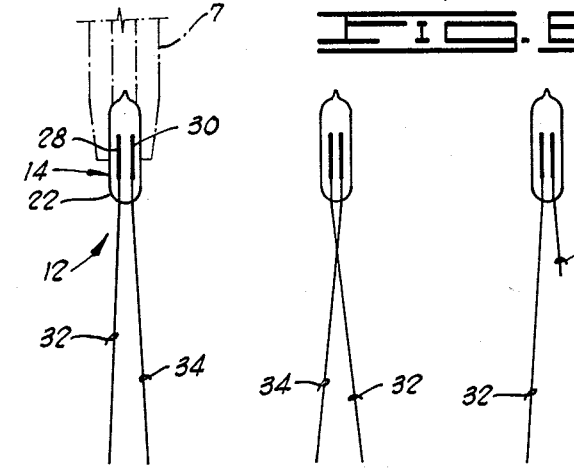
FIG. 25
FIG. 25A
FIG. 26
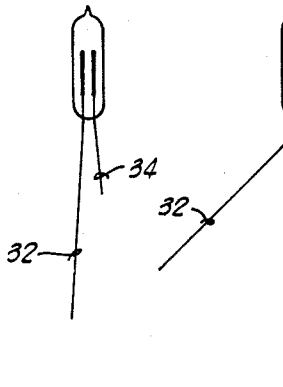
FIG. 26A
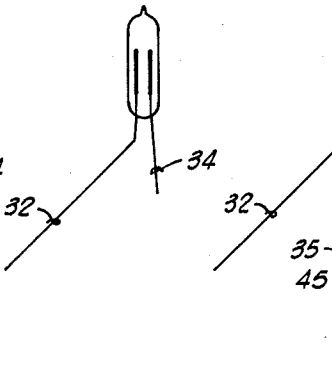
FIG. 27
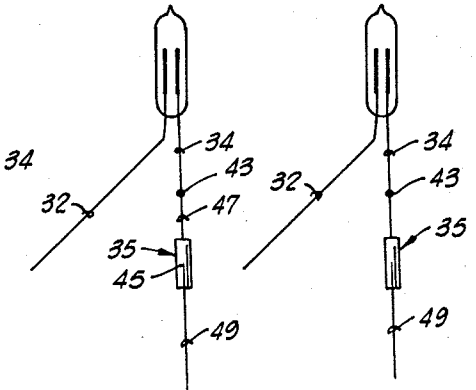
FIG. 28
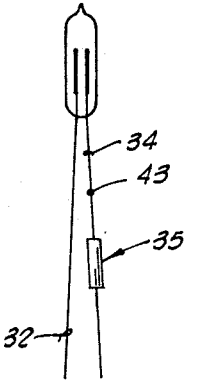
FIG. 29
FIG. 30

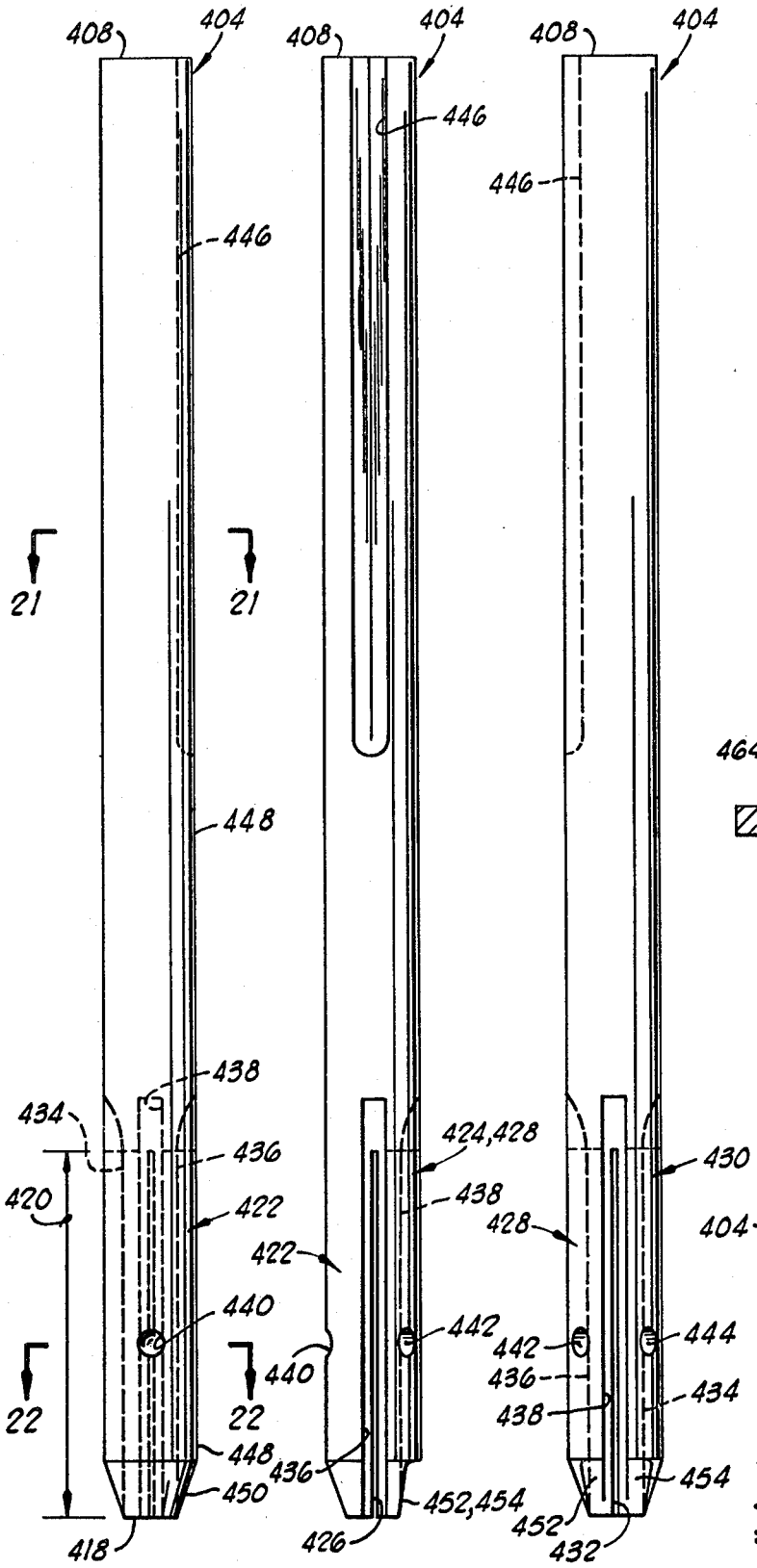
FIG. 19
FIG. 18
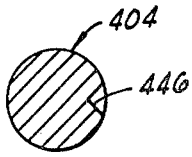
FIG. 21
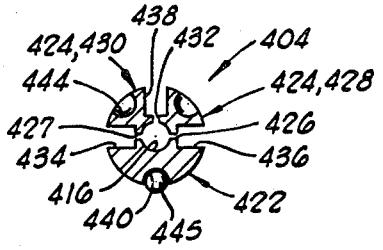
FIG. 22
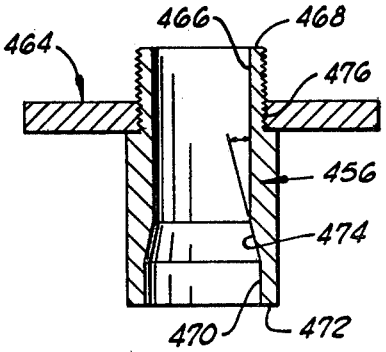
FIG. 23
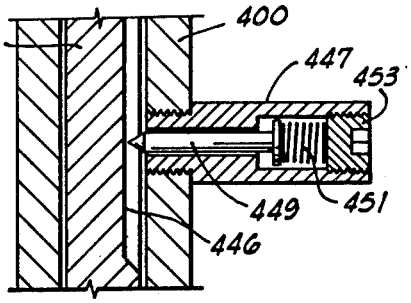
FIG. 24
FIG. 20

AUTOMATED WELDING SYSTEMS AND METHODS

BACKGROUND OF THE INVENTION

1. Brief Description of the Invention

The present invention relates generally to apparatus and methods for welding lead wires of first electrical components to lead wires of second electrical components, and more particularly, but not by way of limitation, to such apparatus and methods where said first electrical components are negative glow lamps.

2. Description of the Prior Art

A negative glow lamp is an electrical component having a cylindrical glass bulb approximately ½" in length and ¼" in diameter. Extending downwardly from the bulb is a lower bulb portion which is a substantially flat tab formed during the bulb manufacturing process. This lower bulb portion extends downward approximately ¼" and has a width of approximately ¼", and a thickness of approximately 1/16". Disposed within the bulb are first and second filaments. Attached to the first and second filaments and extending downwardly from the lower bulb portion are first and second copper lead wires having a length of approximately 1½". These lead wires are substantially parallel and lie substantially in the plane of the flat tab extending down from the bulb.

Such negative glow lamps are used in large numbers by manufacturers of electrical equipment. Often it is necessary that a resistor be welded to one of the lead wires of each of the negative glow lamps.

Prior art methods of handling such negative glow lamps during the process of welding resistors to the glow lamps, have involved the manual handling of each individual lamp at numerous stages. This adds greatly to the expense of manufacturing the finished lamps.

SUMMARY OF THE INVENTION

An automated system is provided for welding resistors to negative glow lamps. An indexing means, mounted on a frame, moves a lamp holder in successive steps to a plurality of positions relative to said frame. A pair of conically tapered rollers orient the negative glow lamps and then feed the lamps to a first one of said positions relative to said frame. The lamp holder receives the lamps one at a time at said first position, and then carries each lamp to a series of operational stations, at one of which a resistor is welded to each lamp.

It is, therefore, a general object of the present invention to provide automated apparatus and methods for welding lead wires of first electrical components to lead wires of second electrical components.

Another object of the present invention is to provide automated apparatus and methods for welding negative glow lamps to resistors.

Other and further objects, features and advantages of the present invention will be readily apparent to those skilled in the art upon a reading of the following disclosure when taken in conjunction with the accompanying drawings.

BRIEF DESCRIPTION OF THE DRAWINGS

FIG. 5 is a rear elevation view of the apparatus of FIGS. 3 and 4 taken along line 5—5 of FIG. 4.

FIG. 6 is a side elevation view of a negative glow lamp with the plane of the paper being defined by the first and second body axes of the negative glow lamp.

FIG. 7 is a side elevation view of the negative glow lamp of FIG. 6, rotated 90° clockwise as viewed from above about its first body axis, so that the plane of the paper is defined by the first and third body axes of the negative glow lamp.

FIGS. 11-15 are a sequential series of elevation views of a lamp holder being actuated to pick up a lamp from between the rollers of FIGS. 3 and 4.

FIG. 18 is a front elevation view of a center rod of the lamp holder, as seen in FIG. 11.

FIG. 19 is another elevation view of the center rod of FIG. 18, rotated 90° clockwise as viewed from above.

FIG. 20 is another elevation view of the center rod of FIG. 18 rotated an additional 90° clockwise relative to the view of FIG. 19.

FIG. 21 is a section view along line 21—21 of FIG. 18.

FIG. 22 is a section view along line 22—22 of FIG. 18.

FIG. 23 is a section elevation view of a cam sleeve of the lamp holder.

FIG. 24 is a section elevation view along line 24—24 of FIG. 11, showing a frictional engagement means for engaging the center rod of FIG. 18.

FIGS. 25-30 are a sequential series of drawings of a negative glow lamp illustrating the operations performed thereon by the automatic welding turntable of FIG. 1.

FIG. 35 is an elevation view along line 35—35 of FIG. 31, showing a means for adjusting the vertical position of a center rod 404 of a lamp holder 7.

DETAILED DESCRIPTION OF THE PREFERRED EMBODIMENTS

Figure 1:
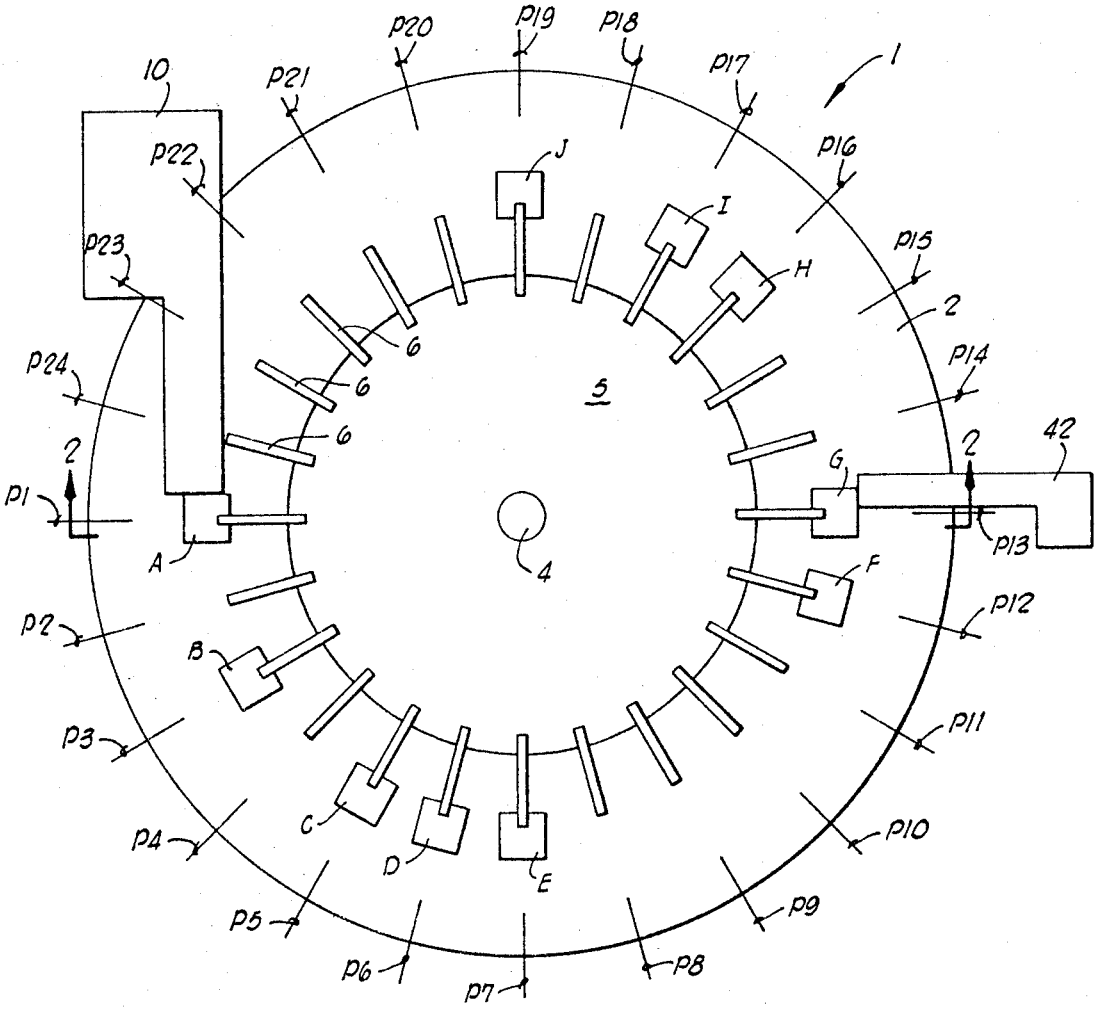
FIG. 1 is a schematic plan view of an automatic welding turntable of the present invention.
Figure 2:
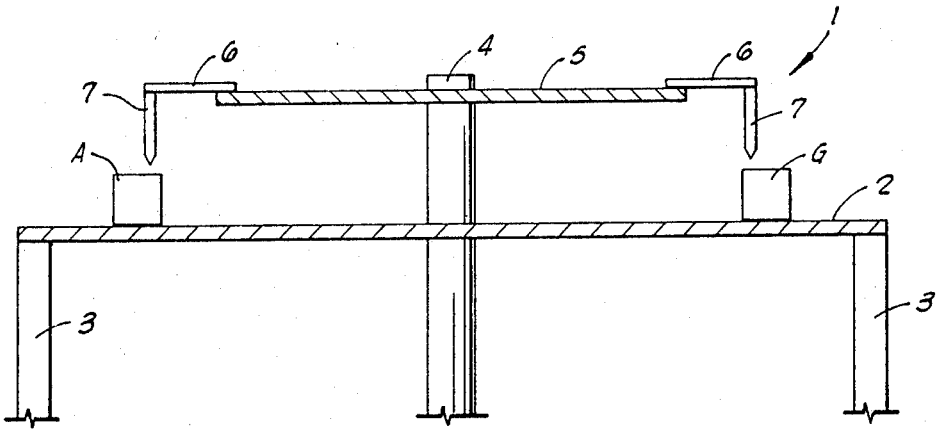
FIG. 2 is a schematic elevation view of the automatic welding turntable of FIG. 1 taken along line 2—2 of FIG. 1.

The Automatic Welding Turntable of FIGS. 1 and 2

Referring now to FIG. 1, an automatic welding turntable assembly is shown and generally designated by the numeral 1. The turntable assembly 1 includes a fixed circular table frame 2 supported from a ground surface by a structural frame 3 (see FIG. 2). Extending upward from the center of table frame 2 is a rotatable shaft 4. Attached to the shaft 4 for rotation therewith is a circular turret frame or indexing plate 5.

Extending radially outward from indexing plate 5 are twenty-four equally angularly spaced indexing arms 6. Thus, adjacent indexing arms 6 are separated by an angle of 15°.

Attached to the rotatable shaft 4 is a drive means (not shown) which provides a means for periodically rotating the shaft 4 through an angle of 15° in a counterclockwise direction as viewed in FIG. 1, then holding rotatable shaft 4 fixed for a period of time, then rotating shaft 4 through a second angle of 15°, then stopping again, etc. Thus, it takes twenty-four steps for any one of the indexing arms 4 to make a complete revolution relative to the table frame 2.

At any given time at which the rotatable shaft 4 is stopped, the indexing arms 6 are oriented as shown in FIG. 1 relative to the table frame 2.

Twenty-four angular positions of the indexing arms 6 relative to the table frame 2 are defined on the table frame 2 and are indicated by angular positions P1–P24 shown in FIG. 1.

Each of the indexing arms 6 includes a lamp holder means 7, as shown schematically in FIG. 2.

Referring to FIGS. 6 and 7, a negative glow lamp 12, which may generally be referred to as an electrical component, is thereshown. The negative glow lamp 12, which itself is well known in the prior art, will now be described for purposes of reference. The negative glow lamp 12 includes a bulb 14. The bulb 14 has a cylindrical portion 16 having a length 18 of approximately ½". The cylindrical portion 16 has an outside diameter, which is its greatest minimum cross-sectional dimension, of approximately ¼". It will be understood that for any section cut through the bulb 14 perpendicular to its longitudinal axis there will be a minimum cross-sectional dimension. The greatest of these minimum cross-sectional dimensions determines the smallest width of a slot through which the bulb 14 could pass.

At the upper end of cylindrical part 16 is a roughly conical closed tip 20 which is formed during the bulb manufacturing process.

Extending downward from the lower end of cylindrical part 16 is a flat bottom bulb portion 22 which closes the bottom of hollow cylindrical part 16. Flat bottom bulb portion 22 has a width 24 of approximately ¼" and has a thickness 26, as can best be seen in FIG. 5, of approximately 1/16".

Figure 4:
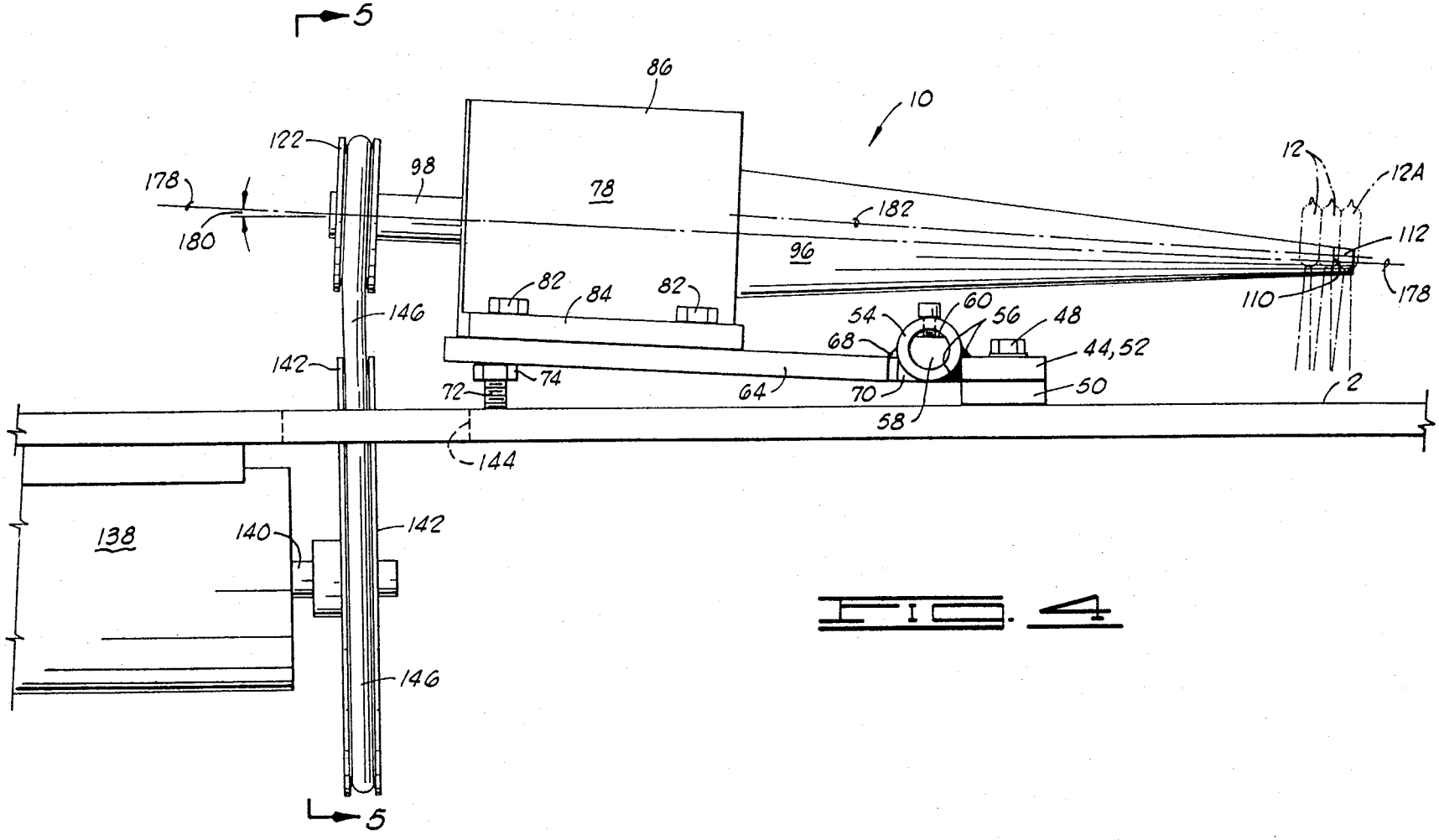
FIG. 4 is a side elevation view of the apparatus of FIG. 3.

Received within bulb 14 are first and second filaments 28 and 30. The filaments 28 and 30 are substantially parallel and spaced apart as can be seen in FIG. 4. Attached to filaments 28 and 30 are first and second lead wires 32 and 34 which extend therefrom downward through the flat bulb portion 22. Lead wires 32 and 34 extend downward a length of approximately 1½" below bulb 14. The lead wires 32 and 34 are encased in lower part 22 of bulb 14 where they pass therethrough and are substantially parallel to each other and lie within the plane of filaments 28 and 30 and the plane of lower bulb portion 22. It will be understood by those skilled in the art, that the lead wires 32 and 34 will, of course, often be slightly bent away from each other or out of the plane of FIG. 6. The construction of the lamp 12 is, however, such that if the lead wires 32 and 34 are not deformed, but rather extend axially from the filaments 28 and 30, they will be substantially parallel to each other and lie in the plane of flat bottom bulb portion 22 and in the plane of filaments 28 and 30.

This is further illustrated in FIG. 7, in which lamp 12 is rotated 90° about a vertical axis from the view shown in FIG. 6, so that only the second filament 30 and the second lead wire 34 are shown.

The geometric configuration of the lamp 12 may best be described by defining first, second and third mutual perpendicular body axes of the lamp 12. Those axes, which will be understood as being imaginary axes, are defined as follows.

A longitudinal axis through cylindrical part 16 of lamp bulb 14 is defined as a first body axis 36. Perpendicular to axis 36 and lying within a plane defined by filaments 28 and 30 and lower flat bulb portion 22 is a second body axis 38. The axes 36 and 38 define the plane of the paper on which FIG. 6 is drawn.

A third body axis 40 is perpendicular to both said first and second axes 36 and 38 and may be seen in FIG. 7 where the axes 36 and 40 define the plane of the paper on which FIG. 7 is drawn.

As can be seen in FIG. 6, the first and second lead wires 32 and 34 extend from lower bulb portion 22 substantially parallel to first body axis 36 and spaced apart in a direction parallel to second axis 38.

Lamps such as the lamp 12 are used in very large numbers by manufacturers of electronic equipment, and to supply such lamps to customers in a form specifically designed for their needs, it is necessary to cut one or more of the lead wires 32 and 34 to a predetermined length, and to weld an electrical resistor, such as the resistor 35 seen in FIGS. 25–30, to one of the lead wires and then trim the length of the wires and then trim the length of the wire extending below the electrical resistor.

The automatic welding turntable 1 provides a totally automated means for accomplishing all of these operations.

At several of the angular positions P1 through P24 around the table frame 2, work stations are provided for performing an operation on the negative glow lamp 12.

At angular position P1, lamps 12 are supplied to a first work station A. At work station A an actuator means is provided for actuating the lamp holding means 7 so that a lamp 12 from a lamp positioning roller assembly 10 is placed within lamp holder means 7 in the manner illustrated in FIG. 25.

With the next rotation of shaft 4, the lamp 12 just picked up at angular position P1 is carried to angular position P2 which is a non-active position, i.e., nothing is done to the lamp 12 at angular position P2.

The next rotation of the rotatable shaft 4 carries the lamp 12 to work station B at angular position P3. It will be appreciated that when the lamp 12 reaches angular position P3, the lead wires 32 and 34 thereof may be oriented in a straight spread manner such as shown in FIG. 25, or they may equally probably be oriented in a skewed crossing manner such as shown in FIG. 25A. The lamps 12 are so handled prior to and during their placement in the lamp positioning roller assembly 10 that the lead wires 32 and 34 may often be bent in an irregular manner.

At work station B at angular position P3 of the table frame 2, the lead wires 32 and 34 are separated to an orientation approximately like that shown in FIG. 25, and then the second lead wire 34 is trimmed to a desired length so that when the lamp 12 leaves work station B its appearance is like that illustrated in FIG. 26.

No. operation is performed on the lamp 12 at angular position P4.

At angular position P5 a work station C returns the lamp holder means 7 to an upwardmost position. Also, a safety switch checks the vertical position of lamp holder 7 to be sure it will clear work station D at angular position P6.

At angular position P6 the work station D includes a cutter means for trimming the length of the first lead wire 32 if desired. If the first lead wire 32 is trimmed, then the lamp 12 will have the appearance illustrated in FIG. 26A where it can be seen that the first lead wire 32 in FIG. 26A is shorter than the first lead wire in FIG. 26.

At angular position P7, a work station E includes a means for straightening the second lead wire 34 and for bending the first lead wire 32 away from the second lead wire 34, so that the lamp 12 has the appearance shown in FIG. 27.

No operation is performed upon the lamp 12 at angular positions P8–P10. At position P11 a safety switch checks the vertical position of lamp holder 7 to be sure it will clear work station G at angular position P13.

At angular position P12, a work station F includes a sensor means for determining whether one of the lamps 12 is present within the lamp holder means 7 carried by the indexing arm 6 which is then located at angular position P12. If no lamp is present the operation next described at angular position P13 is eliminated at the next angular step movement of shaft 4 so as to prevent the wasting of resistors 35.

At angular position P13, a work station G includes a means for welding a resistor 35, which is supplied to the work station G by a resistor feeder means 42, to second lead wire 34. As the lamp 12 leaves angular position P13, it has the appearance illustrated in FIG. 28 with the weld between resistor 35 and second lead wire 34 indicated at 43.

The resistor 35 is a standard type of resistor having a resistor element 45 with first and second resistor lead wires 47 and 49 extending therefrom. It is the first resistor lead wire 47 which is attached to the second lamp lead wire 34 at weld 43.

No operation is performed on the lamp 12 at angular positions P14 and P15.

At angular position P16, a work station H includes a means for trimming the length of second resistor lead wire 49 so that the lamp 12 has the appearance shown in FIG. 29 as it leaves angular position P16.

At angular position P17, a work station I includes a means for straightening the first lamp lead wire 32 and for exerting a downward pull upon the resistor element 45 to test the weld 43. When lamp 12 leaves work station I of angular position P17, it has the appearance illustrated in FIG. 30, if the weld 43 was acceptable. If the weld 43 was not acceptable, that weld will break during the testing operation performed at work station I and the resistor 35 will be pulled off of the lamp 12.

No operation is performed on the lamp 12 at angular position P18.

At angular position P19 a work station J includes a release mechanism for engaging the lamp holder means 7 to cause it to release the lamp 12 and drop the same downward through an opening (not shown) in the table frame 2 to a receiving bin (not shown) located therebelow.

No operation is performed at angular positions P20–P23. At position P24 a safety sensor checks for the presence of a lamp 12 in lamp holder 7, and if a lamp is present the entire system 1 is shut down. When the indexing arm 6 returns to angular position P1, the cycle starts over again and is repeated.

THE POSITIONING ROLLERS OF FIGS. 3–5

Figure 3:
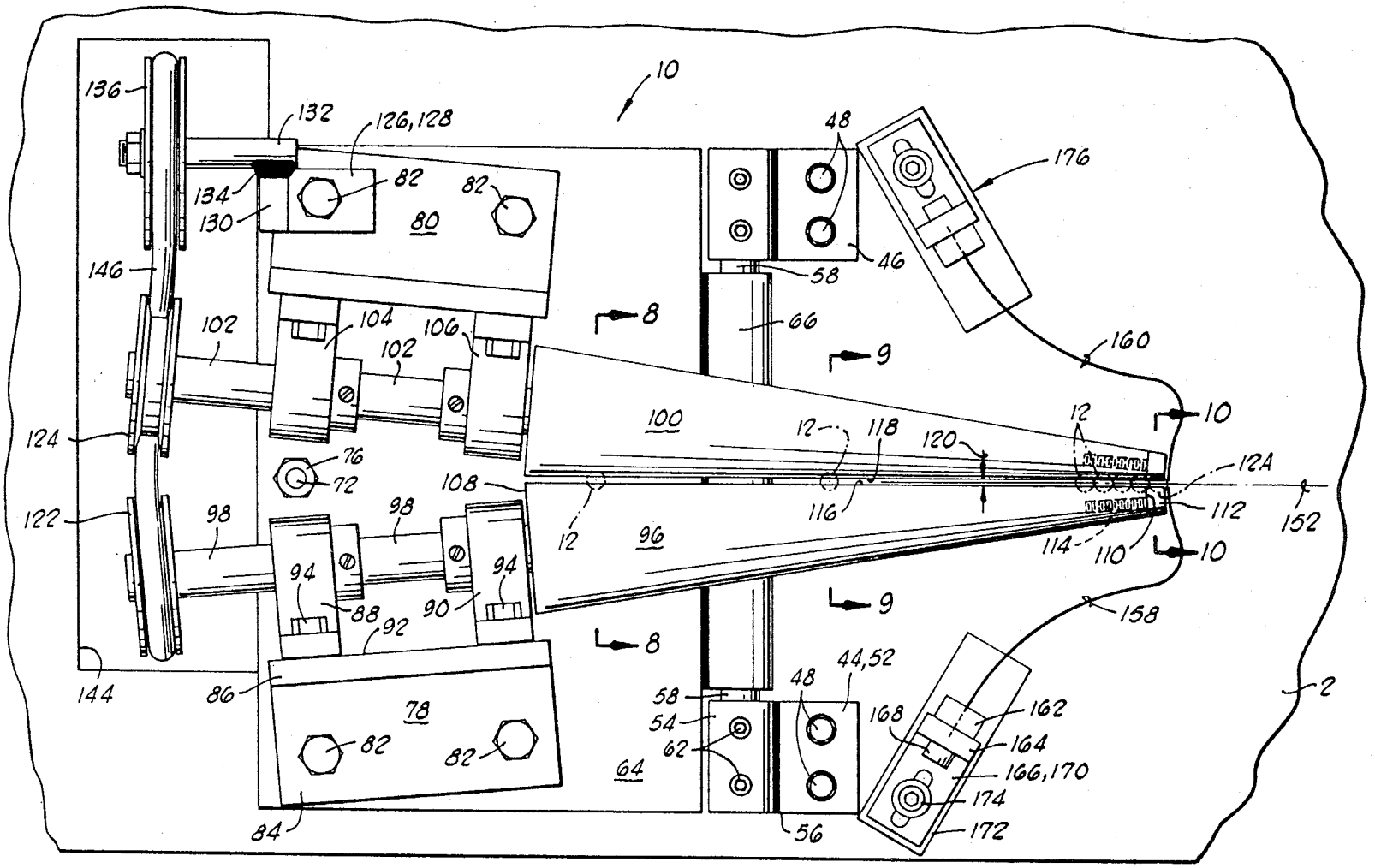
FIG. 3 is a plan view of a lamp positioning roller assembly.

Referring to FIGS. 3 and 4, the lamp positioning roller assembly is thereshown and generally designated by the numeral 10. Roller assembly 10 is mounted upon the table frame 2. First and second roller attachment hinges 44 and 46 are attached to table frame 2 by allen screws 48. The table frame 2 is threaded and tapped to receive the allen screws 48.

Shims 50 are placed below roller attachment hinges 44 and 46 to adjust a vertical position thereof.

First roller attachment hinge 44 includes a plate portion 52 having a hollow cylindrical portion 54 welded to the back edge thereof at weld 56. Second roller attachment hinge 46 is similarly constructed.

A hinge bar 58 is received within the inner bores of first and second roller attachment hinges 44 and 46. Each end of hinge bar 58 includes a flat surface 60.

Hollow cylindrical part 54 of first roller attachment hinge 44 has two threaded holes in the upper side thereof within which are received allen screws 62 which are utilized as set screws to set against flat surface 60 of hinge bar 58 to fix hinge bar 58 relative to hollow cylindrical part 54.

A roller carrier plate 64 has a hollow cylindrical middle hinge portion 66 attached to a front edge thereof by welding as shown at 68 and 70.

Hinge bar 58 is received through central bore of middle hinge portion 66 which is rotatable relative thereto so that roller carrier plate 64 may be rotatably adjusted about the horizontal longitudinal axis of pivot bar 58 relative to table frame 2.

An adjustment bolt 72 extends upward from table frame 2 and has lower and upper adjustment nuts 74 and 76 threadedly engaged therewith and engaging lower and upper surfaces, respectively, of roller carrier plate 64. Thus, the rotational position of carrier plate 64 about pivot bar 58 may be adjusted by rotating the nuts 74 and 76 upon the threads of adjustment bolt 72.

First and second L-shaped roller support brackets 78 and 80 are attached to roller carrier plate 64 by allen screws 82.

First support bracket 78 includes a shorter horizontal leg 84 and a longer vertical leg 86. Second support bracket 80 is similarly constructed. First and second bearing blocks 88 and 90 are attached to an inner surface 92 of vertical leg 86 of first support bracket 78 by allen screws 94.

A first substantially horizontally extending conically tapered roller 96 includes a shaft 98 extending rearwardly therefrom which is rotatably received within bearing blocks 88 and 90.

Similarly, a second roller 100 has a shaft 102 which is received within bearing blocks 104 and 106 which are attached to second support bracket 80.

In a preferred embodiment of the tapered rollers 96 and 100, the roller 96 has a rear end 108 with a diameter of 2" and has a front end 110 with a diameter of 0.380". Roller 96 has an axial length of $9\frac{7}{8}$" between front and rear ends 110 and 108. A hardened tool steel tip insert 112 has a threaded bolt extending rearwardly thereof which is received within threaded and tapped hole 114 in front end 110 of roller 96. Tip insert 112 is tapered continuously along the profile projecting from the outer surface of roller 96.

Second roller 100 is constructed similarly to first roller 96.

As shown in FIG. 3, the innermost or closest edges 116 and 118 of rollers 96 and 100 are oriented parallel to each other and spaced apart by a distance 120 which in a preferred embodiment is $\frac{1}{8}$".

Attached to the rear end of shafts 98 and 102 of first and second rollers 96 and 100 are first and second roller drive pulleys 122 and 124, respectively.

An L-shaped idler support bracket 126 having a horizontal leg 128 and a vertical leg 130 is attached to a second roller support bracket 80 by one of the allen screws 82. An idler stub shaft 132 is welded to the vertical leg 130 of idler support bracket 126 at weld 134. Rotatably attached to idler stub shaft 132 is an idler pulley 136.

As is best seen in FIG. 4, there is attached to the bottom of table frame 2 an electric drive motor 138. A shaft 140 extends forwardly of motor 138 and has a motor pulley 142 attached thereto.

As best seen in FIGS. 3 and 5, table frame 2 includes an elongated cut out slot 144 through which an upper portion of motor pulley 142 extends. FIG. 5 is a view along line 5–5 of FIG. 4. An endless drive belt, which preferably has a round cross section, is designated by the numeral 146. Drive belt 146 extends under motor pulley 142 then over first drive pulley 122, then under second drive pulley 124, then over idler pulley 136, then back to motor pulley 142.

In this manner, rotation of motor pulley 142 by electric drive motor 138 causes the tapered rollers 96 and 100 to rotate toward each other from above in opposite directions as indicated by arrows 148 and 150, respectively, in FIG. 5.

Manner of Operation of Rollers of FIGS. 3–5

The manner of operation of the roller assembly 10 is as follows.

A plurality of lamps 12 are placed between the rollers 96and 100 as they are rotating in the manner previously described. These lamps are initially placed between the rollers near the larger ends thereof approximately at the location of the lamp 12 illustrated in phantom lines in FIG. 3 through which the section line 8—8 is drawn.

These lamps 12 may be fed onto the roller assembly 10 in several ways. They may, for example, be dropped on top of the rollers 96 and 100 by a conveyor, or they may be stored in a large tray mounted above the rollers and may be periodically dropped onto the rollers by hand or by hand-assisted movement down a sloped chute from the storage tray.

When the lamps 12 are initially placed on top of the rollers 96 and 100, they need not be oriented in any particular manner. The orientation is accomplished by the rotating rollers regardless of the initial orientation of the lamp 12 when it is dropped on top of the rollers 96 and 100.

As mentioned above, each of the lamps 12 includes the lamp bulb 14 having a lower bulb portion 22 extending from bulb 14 in a direction parallel to the first axis 36 of the bulb 14. The lower bulb portion 22 has a width 24 in a direction parallel to the second body axis 38 of the bulb, and has a thickness 26 less than the width 24 in a direction parallel to a third body axis 40 of the bulb. The first, second and third body axes of the bulb 14 are mutually perpendicular. The first and second lead wires 32 and 34 extend from the lower bulb portion 22 substantially parallel to the first body axis 36 and spaced apart in a direction parallel to the second axis 38.

When such a bulb is placed between the rollers 96 and 100, those rollers orient the bulb so that its first body axis 36 is vertical, with its lead wires 32 and 34 extending downward from the bulb 14, and so that its second body axis 38 is parallel to a predetermined horizontal line 152. It will be understood that once the first and second body axes are oriented, the orientation of the third body axis 40 is necessarily determined thereby. The predetermined horizontal line 152 is parallel to the innermost edges 116 and 118 of rollers 96 and 100 and lies therebetween as projected onto an imaginary horizontal surface.

This orientation is accomplished in the following manner.

When the bulb 12 is initially placed between the rollers 96 and 100 it may be in any orientation. The sliding movement of the rollers 96 and 100 relative to the glass bulb 14 overcomes any static friction between the bulb 14 and the surface of the rollers and causes the bulb 14 to seek to position itself so that it has a minimum gravitational potential energy. In other words, it will fall to the lowest level possible.

The dimensions of the rollers relative to the bulb 14 are such that the rollers contact the outer surface of cylindrical part 16, and since the end of the bulb 14 from which the lead wires 32 and 34 is the heaviest, with the center of gravity of the entire lamp 12 being in the area of the junction between cylindrical part 16 and flat bulb portion 22, the lead wires 32 and 34 will swing downward between the rollers 96 and 100 thereby giving the lamp 12 an orientation such that its first body axis 36 is vertically oriented with lead wires extending down from the bulb.

Since the lamp 12 can ride lower between the rollers if it is oriented with its second body axis 38 parallel to predetermined line 152 rather than having its third body axis 40 parallel to said predetermined line, and since the lower corners 154 and 156 of lower bulb part 22 are rounded as seen in FIG. 6, the bulb 12 will orient itself with its second body axis 38 parallel to predetermined line 152.

This entire orientation process takes place very quickly, on the order of one second, once the bulb is dropped between the rotating rollers.

Then the oriented bulb 12 migrates from the position through which section line 8—8 is drawn toward the small ends of the rollers. This is because the elevation at which the bulb 14 of lamp 12 contacts the rollers 96 and 100 drops as the bulb moves to the right as shown in FIG. 3. Again, the continued rotation of the rollers 96 and 100 eliminates static friction between those rollers and the bulb and thus the bulb slowly slides down toward the small end of the tapered rollers.

It is preferable that the surface of the rollers 96 and 100 be finished to at least a No. 8 glossy polish so that the glass bulbs slide freely relative thereto and are not crushed between the rollers. It will be understood that with any particular type of electrical component to be aligned by an apparatus such as that of roller assembly 10, it is necessary that the material against which the rollers are sliding be taken into consideration and that the rollers be so constructed and finished as to provide a sufficiently low co-efficient of friction with the electrical component body to prevent the electrical components from being pulled down between the rollers and crushed.

The sloped line of engagement between the bulbs and the rollers causes the rollers to feed the bulbs to the right, as seen in FIGS. 3 and 4, towards a forwardmost position such as is represented by forwardmost bulb 12A, where the bulb is held between the roller tip inserts such as tip insert 112. Further lateral movement of the right of the forwardmost bulb 12A is prevented by a pair of spring wires 158 and 160, the ends of which engage the forwardmost bulb 12A to resiliently retain the bulb 12A from any further lateral movement to the right. Thus, the bulbs 12 will line up contacting each other, and supported against the forwardmost bulb 12A as shown in FIGS. 3 and 4, and as the forwardmost bulb 12A is removed by one of the lamp holders 7 the other bulbs are sequentially fed to said predetermined position in space.

The first spring wire 158 is held in a carried block 162 which is adjustably attached to a vertical leg 164 of an angle shaped bracket 166 by allen screw 168. A horizontal leg 170 of bracket 166 is horizontally adjustably attached to a mounting plate 172 by an allen screw 174. Mounting plate 172 is attached to table frame 2.

A second spring wire holder assembly 176 is similarly constructed and is attached to second spring wire 160.

Thus, the forwardmost lamp 12A is releasably retained at a predetermined position in space, said predetermined position including a predetermined location in space defined between the small ends of rollers 96 and 100 and laterally defined by engagement of forwardmost bulb 12A with spring wires 158 and 160, and including a predetermined orientation about each of three mutually perpendicular spatial axes so that the first body axis of the bulb 12A is oriented vertically with the second body axis of the bulb 12A oriented parallel to predetermined line 152.

Figure 8:
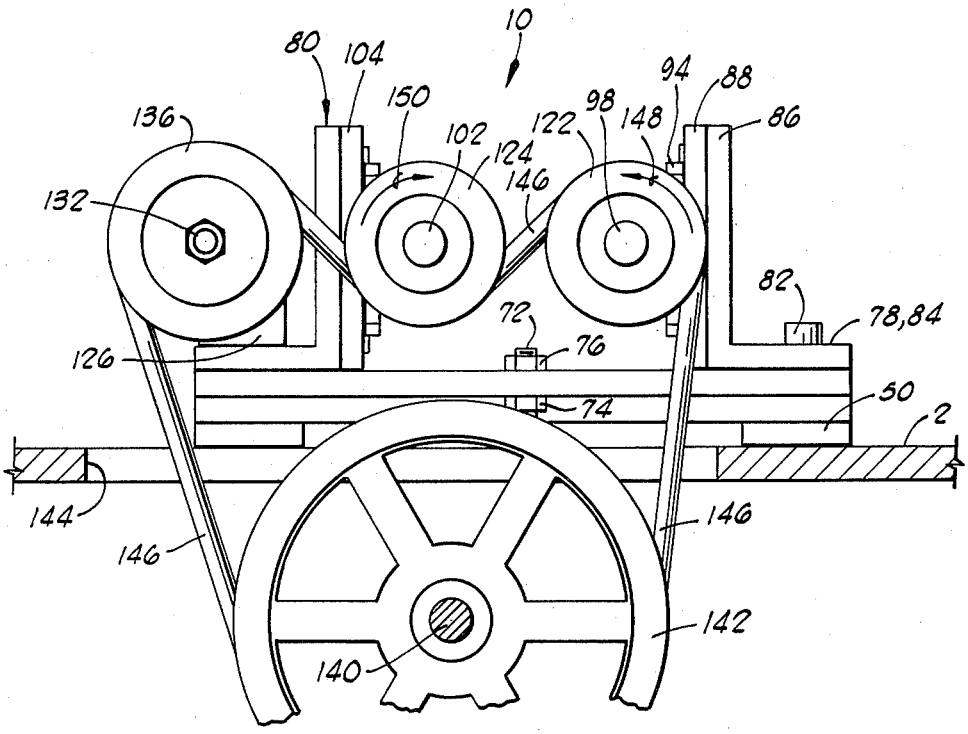
FIGS. 8, 9 and 10 are sectional views taken along lines 8—8, 9—9, and 10—10, respectively, of FIG. 3, illustrating the manner in which a negative glow lamp engages the tapered rollers at each of those locations.
Figure 8:
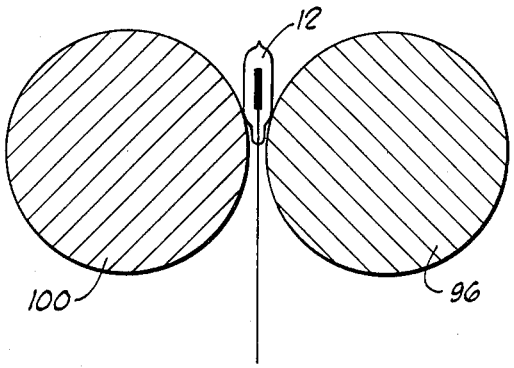
Figure 9:
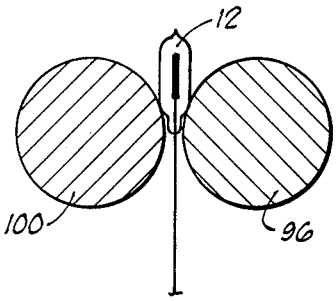
Figure 10:
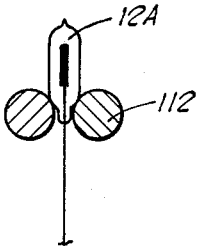

The manner in which the line of contact, between the bulbs 14 and the rollers 96 and 100, slopes downward to the right as the bulbs travel to the right, can best be understood by viewing FIGS. 4, 8, 9 and 10. FIGS. 8, 9 and 10 are section views taken along the sections indicated at FIG. 3.

As best can be seen in FIG. 4, an axis of rotation 178 of first roller 96, which in elevation is parallel to the axis of rotation of roller 100, but which in plan is not as can be seen in FIG. 3, is not horizontally oriented, but rather is tilted downward to the right at a slight angle 180 from the horizontal.

Even if the rollers 96 and 100 were cylindrical rollers, it will be appreciated that if the axis of rotation of those rollers were tilted from the horizontal, then the line of contact of the bulbs with the rollers, which line of contact would be parallel to the axis of rotation, would also be sloped and thus the bulbs could slide down the sloped roller assembly.

With the tapered rollers 96 and 100 of the present invention, another factor is introduced in that, even if the rotational axis such as axis 178 were horizontal, the line of contact between the bulbs 14 and the rollers would still be sloped "downward" toward the small end of the rollers because the bulbs are held at a higher elevation when they are near the large end of the rollers than they are when they are near the small end of the rollers. This can best be appreciated by viewing FIGS. 8, 9 and 10 which illustrate the relative position of bulb 12 as it moves to the right between the rollers 96 and 100.

The line of contact between the bulbs 12 and the roller 96 is designated as 182 in FIG. 4, and it can be seen that the line 182 is not parallel to the axis of rotation 178, but rather the axis 178 and the line 182 converge to the right.

For a given type of electrical component and a given coefficient of friction between that component and the rollers, the line of contact 182 must be sloped sufficiently so that the gravitational force acting upon the electrical components is sufficient to overcome sliding frictional resistance and then the lamps will slide down the rollers. Thus, when rollers 96 and 100 are described as "substantially horizontally extending" it will be understood that their axes of rotation need not be exactly horizontal.

For the glass bulbs 14 of lamps 12 having the dimensions previously described, and for the rollers 96 and 100 having the dimensions previously described and having a No. 8 glossy polish, it is desirable that the axis of rotation 178 be sloped approximately 7°, i.e. the angle 180 should be approximately 7°.

Adjustment bolt 72 provides a means for adjusting the degree of slope of the line of contact 182.

Another important feature provided by the conical taper of rollers 96 and 100 is that the final position of each lamp 12 is between the small ends of the rollers. This makes it much easier to then engage the lamps with one of the lamp holders 7 than it would be if the rollers were not tapered and were instead cylindrical with a diameter equal to that of large end 108. If the rollers were cylindrical with a constant diameter like small end 110, on the other hand, they would be much less effective for initially orienting the lamps. Thus tapered rollers are far superior to cylindrical rollers.

LAMP HOLDER

Figure 11:
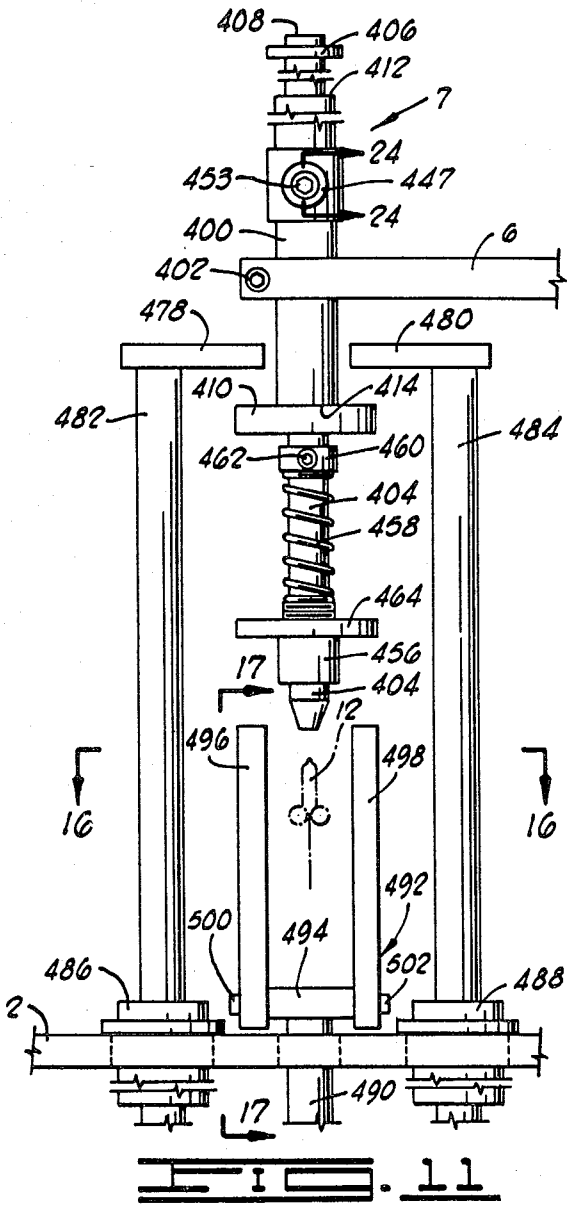

Referring now to FIG. 11, a front elevation view of one of the lamp holders 7 and the associated apparatus of work station A is thereshown in the initial position thereof at the time one of the indexing arms 6 first moves to the angular position P1 upon the work table 2. When FIG. 11 is described as a front elevation view, that means that it is viewed as if it were being viewed from angular position P2 looking back toward angular position P1, so that the tapered alignment rollers 96 and 100 are on the opposite side of lamp holder 7 from the viewer.

Lamp holder 7 includes a friction tube 400 which is fixedly clamped to indexing arm 6 by means of an allen screw 402 which tightens a split end (not shown) of indexing arm 6 about friction tube 400.

Slidably received within friction tube 400 is a center rod 404 which has a friction fit within friction tube 400 so that the vertical position of center rod 404 within friction tube 400 is maintained in the absence of any vertical force other than gravity being applied to the center rod 404. In other words, when the center rod 404 is removed to a given position relative to friction tube 400, that position is maintained until the center rod 404 is mechanically engaged and pushed to another position within the friction tube 400.

An upper retaining ring 406 is fixedly attached to center rod 404 near its upper end 408 and a lower retaining ring 410 is fixedly attached to center rod 404 at an intermediate part thereof. Vertical movement of center rod 404 within friction tube 400 is limited at its downwardmost and upwardmost extents by engagement of the upper and lower retaining rings 406 and 410 with upper and lower ends 412 and 414, respectively, of friction tube 400.

Referring now to FIGS. 18–22, the construction of center rod 404 is there further illustrated.

A blind center bore 416 (see FIG. 22) extends axially upward from a lower end 418 of center rod 404 for a distance 420 (see FIG. 18).

The length 420 of the lower portion of center rod 404 is divided into first and second semi-cylindrical halves 422 and 424 by axial planar cuts 426 and 427.

The second semi-cylindrical half 424 is divided into first and second quarter cylindrical portions 428 and 430, respectively, by an axial planar cut 432 (see FIG. 20).

As can be seen in FIGS. 18–20, the axial planar cuts 426 and 432 extend for the same length 420 as does the center bore 416.

These axial planar cuts have divided the lower portion of lamp holder 404 into three downwardly cantilevered spring fingers 422, 428 and 430 which may be compressed radially inwardly to grasp the outer diameter of a lamp 12 within the center bore 416 as is further described below. First, second and third longitudinal grooves 434, 436 and 438 are machined into the outer surface of center rod 404 coincident with the points of communication of axial planar cuts 427, 426 and 432 with the outer surface of center rod 404.

Radial blind bores 440, 442 and 444, each having hemispherical bottoms, are drilled into first, second and third spring fingers 422, 428 and 430 for receiving a ball which closely fits therein. In FIG. 22, bore 440 is shown as havng a ball 445 disposed therein. Balls such as 445 may generally be referred to as radial protrusions of the fingers 422, 428 and 430.

An upper portion of center rod 404 has a longitudinal groove 446 therein. This is best seen in FIG. 24, which is a view along line 24—24 of FIG. 11. A handle 447 extends horizontally from friction tube 400. Disposed within handle 447 is a plunger 449 which is biased into the groove 446 by a compression spring 451 which abuts a set screw 453. Plunger 449 is constructed from a rigid fibrous material similar to that from which automobile brake linings are constructed.

Center rod 404 has a constant diameter cylindrical outer surface 448 extending downward from upper end 408 for substantially its entire length except for a short downwardly tapered conical outer surface 450 adjacent lower end 418.

As can be seen in FIGS. 19 and 20, flat spots 452 and 454 are machined on the back sides of second and third spring fingers 428 and 430 for the length of the tapered surface portion 450. These flat spots are very important regarding the function of the center rod 404 as it interrelates with the lamp alignment roller assembly 10. The lamps 12 are aligned between rollers 96 and 100 so that they are vertically oriented and closely packed together. If it were not for the flat spots 452 and 454 on the back side of the spring fingers 428 and 430 of center rod 404, then when center rod 404 was lowered over the forwardmost lamp 12A between the rollers 96 and 100, it would be likely to crush the second forwardmost lamp which was adjacent to the lamp 12A being picked up. This is prevented by the presence of flat spots 452 and 454.

Referring again to FIG. 11, a cam sleeve 456 is received about center rod 404 near the lower end 418 thereof. Received around center rod 404 above cam sleeve 456 is a clamping spring 458 which is a coil compression spring.

The upper end of clamping spring 458 abuts against a spring retaining collar 460, the position of which is fixed relative to center rod 404 by an allen screw 462. The compression of spring 458 may be adjusted by loosening screw 462, moving collar 460, and then tightening screw 462 against center rod 404. Thus, the spring 458 biases the cam sleeve 456 downward relative to the center rod 404. An actuating collar 464 is attached to cam sleeve 456 and extends radially outward therefrom.

The construction of cam sleeve 456 and actuating collar 464 are best seen in FIG. 23 which is a sectional elevation view thereof.

Cam sleeve 456 has a center bore 466 extending downward from the upper end 468 thereof. A counter bore 470 extends upward from a lower end 472, and the bores 466 and 470 are connected by a tapered conical cam surface 474.

The actuating collar 464 is threadedly attached to cam sleeve 456 at threaded connection 476.

When the cam sleeve 456 is assembled with center rod 404 as shown in FIG. 11, the tapered cam surface 474 engages the ball bearings 445 received in radial blind bores 440, 442 and 444 of first, second and third spring fingers 422, 428 and 430. Thus, the downward biasing force from coil spring 458 acting against cam sleeve 456 causes cam surface 474 to press downwardly against the ball bearings 445 thereby urging the ball bearings and their associated spring fingers 422, 428 and 430 radially inward so that a lamp 12 received within the central bore 416 of center rod 404 is clamped therein by the inward bias of the spring fingers. Lamp 12 may be released from the center rod 404 by pushing upward on the actuating collar 464 thereby moving cam sleeve 456 upward relative to center rod 404 so as to move the cam sleeve 474 out of engagement with the ball bearings.

The manner in which the lamp holder 7 is operated at work station A so as to pick up one of the lamps 12 from the lamp alignment roller assembly 10 will now be described with reference to sequential FIGS. 11–15.

Referring now to FIG. 11, the initial position of the lamp holder 7 is shown when it is first moved to angular position by P1 by rotation of the indexing arm 6 relative to the work table 2. It is seen that the center rod 404 is in its upwardmost position relative to friction tube 400 so that the lower retaining ring 410 is in engagement with the lower end 414 of friction tube 400. The cam sleeve 456 is biased downward by compression spring 458 so that the spring fingers 422, 428 and 430 are compressed inward.

First and second upper actuating arms 478 and 480 are attached to first and second vertical actuating rods 482 and 484 which extend upward through guide sleeves 486 and 488 attached to and disposed through working table 2. The actuating rods 482 and 484 are connected to a common linkage below working table 2 so that the rods 482 and 484 are fixedly connected together so that they move upwardly or downward simultaneously maintaining the first and second actuating arms 478 and 480 at identical elevations.

A third actuating rod 490 extends upward through working table 2 and has a lower actuating assembly 492 attached thereto. Lower actuating assembly 492 includes a center plate 494 attached to the upper end of actuating rod 490.

Figure 17:
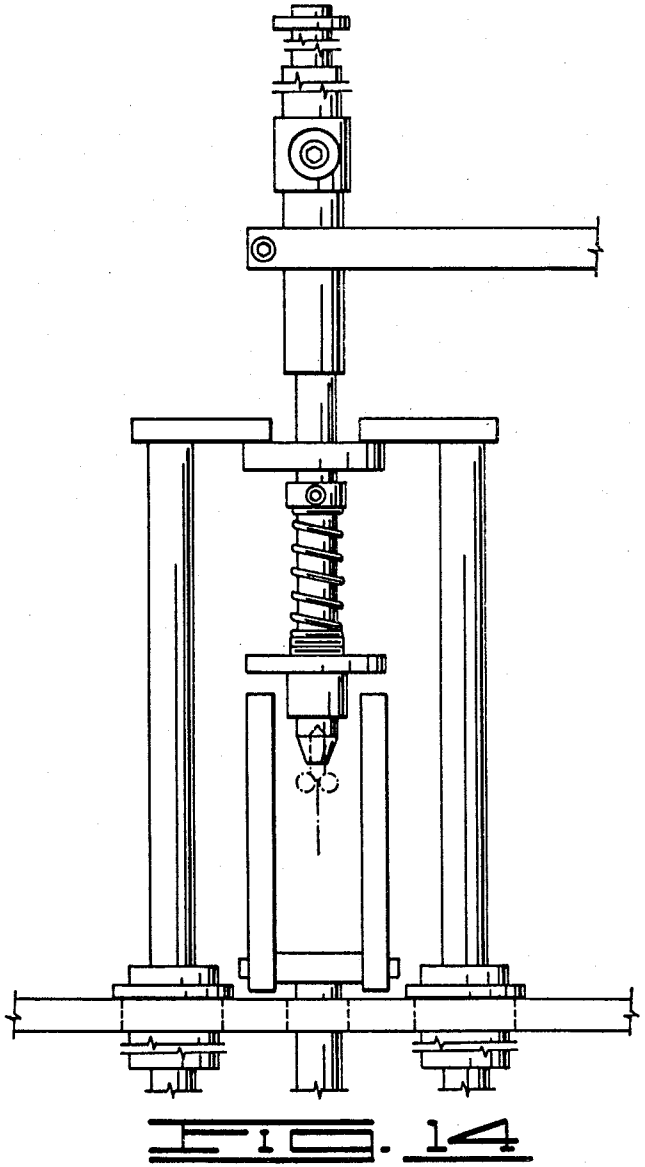
FIG. 17 is a sectional elevation view along line 17—17 of FIG. 11.
Figure 16:
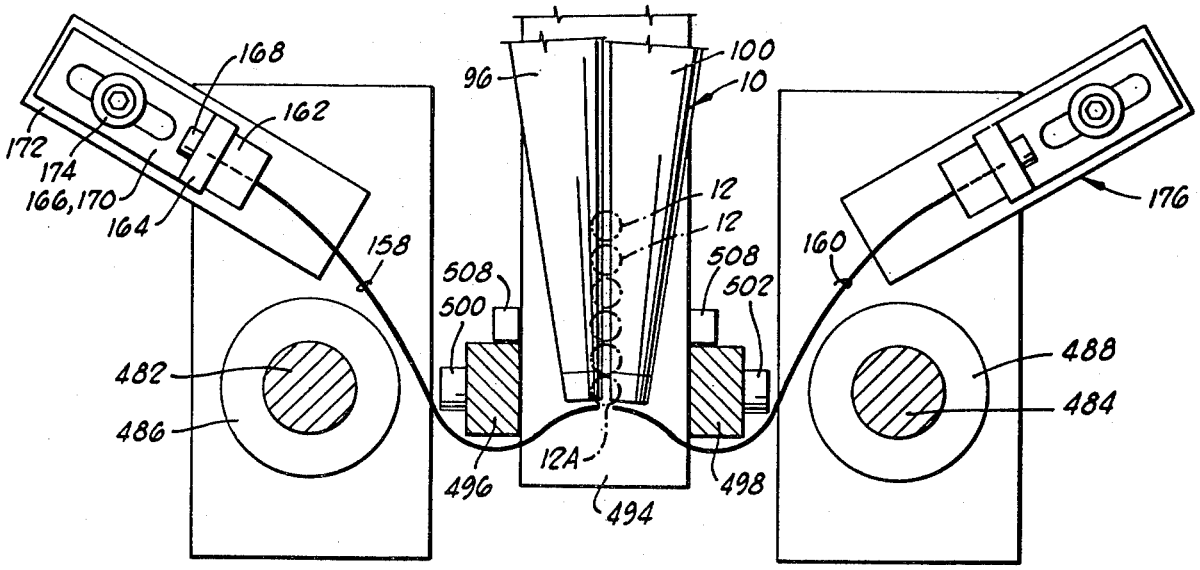
Figure 17:
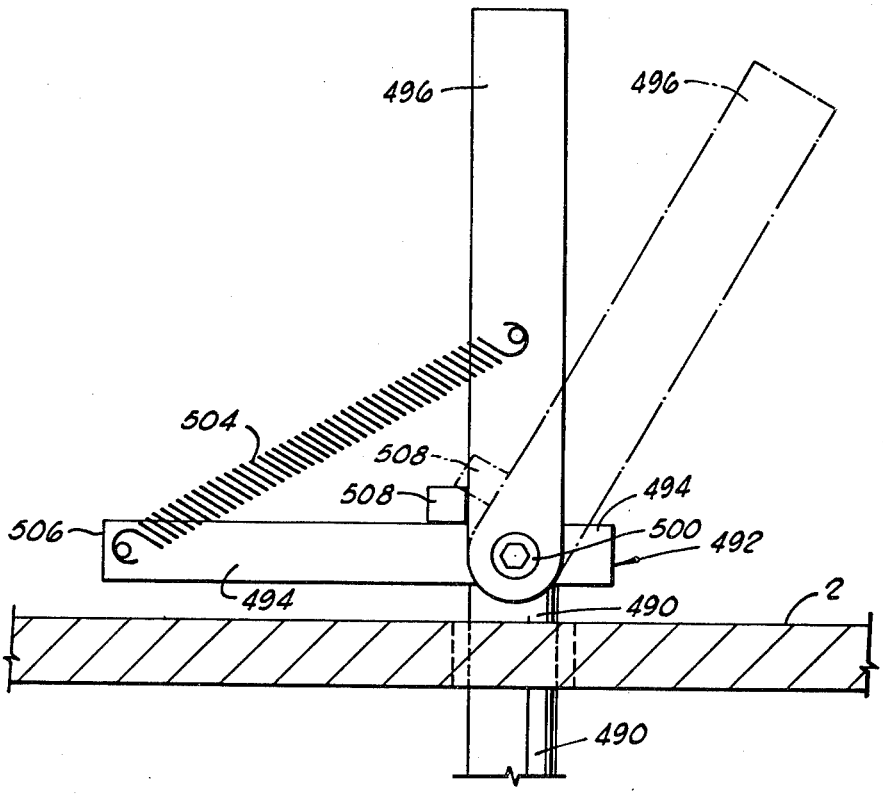

The lower actuating assembly 492 is best shown in FIG. 17.

First and second lower actuating arms 492 and 498 are pivotally attached to center plate 494 by pivot pins 500 and 502.

The coil tension springs 504, only one of which can be seen in FIG. 17, are connected between a rearward end 506 of center plate 494 and each of the lower actuating arms 496 and 498 so as to bias the actuating arms 496 and 498 counterclockwise as seen in FIG. 17.

Each of the lower actuating arms 496 and 498 includes a limit dog 508 fixedly attached to the rear edge thereof for engagement with center plate 494 so as to limit the counterclockwise motion of the lower actuating arms 496 and 498 as seen in FIG. 17 relative to center plate 494. Thus, the lower actuating assembly 492 normally is in the orientation shown in solid lines in FIG. 17. If, however, the actuating arms 496 and 498 should be engaged by an erroneously positioned lamp holder 7, which for example may have accidentally fallen relative to friction tube 400, then the spring loaded lower actuating arms 496 and 498 can merely pivot foward to a position such as that shown in phantom lines in FIG. 17 thereby preventing damage to the lower actuating assembly 492 or the lamp holder 7.

The lower actuating assembly 492 is shown in FIG. 11 in its inital lowermost position relative to work table 2.

The lamp holder 7 will subsequentially be actuated by the upper actuating arms 478 and 480 and the lower actuating arms 496 and 498 in such a manner that the cam sleeve 456 is moved upward relative to center rod 404 thereby allowing the spring fingers 422, 428 and 430 to spring outward so that the center rod 404 may be lowered over the lamp 12 so that the lamp 12 is received within the center bore 416 of center rod 404. Then the spring 458 will be allowed to expand thereby moving the cam sleeve 456 downward and clamping the spring fingers 422, 428 and 430 about the lamp 12. Both the lower and upper actuating arms then move out of engagement with the lamp holder 7 which has the lamp 12 securely clamped therein. Then the next rotational indexing motion of the indexing arm 6 attached to the lamp holder 7 at work station A at angular position P1, carries the lamp 12 forward out of the plane of the paper of FIG. 11. Thus, the lamp 12 is engaged and carried away from the lamp alignment roller assembly 10 without any upward or downward motion of the lamp 12.

This all occurs in the following manner.

Figure 12:
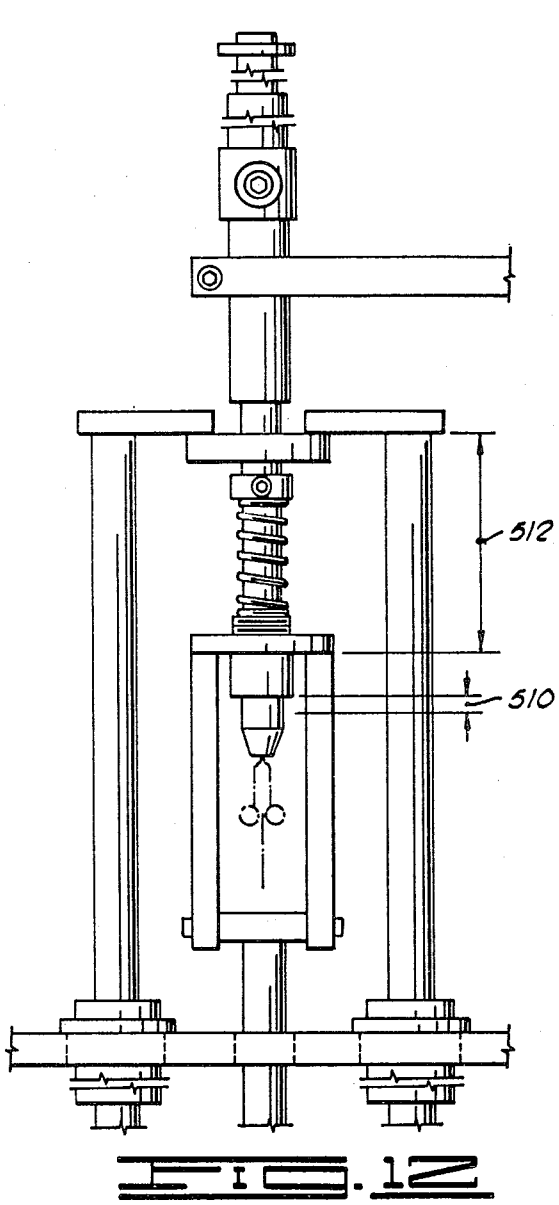

From the positions shown in FIG. 11, the upper actuating arms 478 and 480 move downward into engagement with the lower retaining ring 410 of lamp holder 112 pulling the center rod 404 downward relative to friction tube 400 to the position shown in FIG. 12. Simultaneously, the lower actuating arms 496 and 498 are moved upward into engagement with the actuating collar 464 to move actuating collar 464 and cam sleeve 456 upward relative to center rod 404 thereby compressing the spring 458 a distance 510 as represented in FIG. 12. This moves the cam surface 474 out of engagement with the ball bearings 445 received within the blind bores 440, 442 and 444 of spring fingers 422, 428 and 430, respectively, so as to allow the spring fingers to spring radially outward.

At this point, a vertical distance 512 is present between the upper actuating arms and the lower actuating arms.

Figure 13:
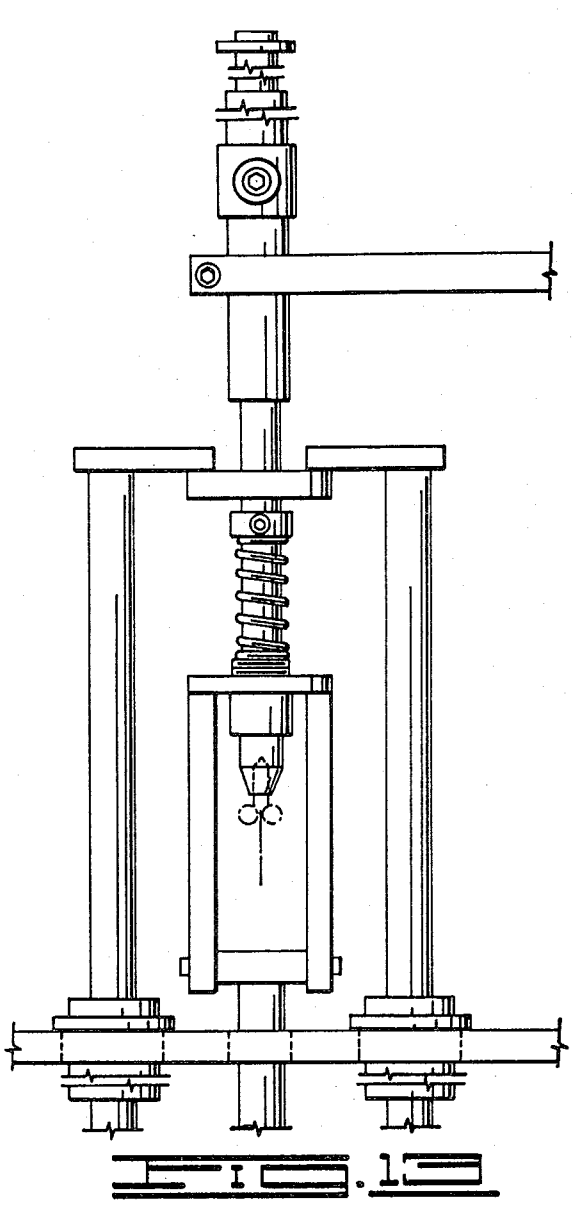

From the position shown in FIG. 12, the upper and lower actuating arms simultaneously move downward at an identical rate so that the distance 512 is constantly maintained until the upper and lower actuating arms reach the position illustrated in FIG. 13, wherein the center bore 416 of center rod 404 is disposed about the forwardmost lamp 12A being held between the tapered rollers 96 and 100. Thus, the actuating arms 478 and 480 may be referred to as a loading means for moving center rod 404 downward relative to lamp 12, with the fingers 422, 428 and 430 in an open position, so that lamp 12 is received in bore 416.

In the position shown in FIG. 13, the spring 458 is still in a compressed state and the spring fingers 422, 428 and 430 have not yet been moved radially inward to clamp the lamp 12 therebetween.

From the position shown in FIG. 13, the lower actuating arms 296 and 298 moved downward to the position shown in FIG. 14. During this movement of the lower actuating arms, the upper actuating arms do not move. Thus, the cam sleeve 456 is allowed to be moved downward relative to the center rod 404 by the downward bias of coil spring 458, thereby urging cam surface 474 against the ball bearings 445 and thus moving the spring fingers 422, 428 and 430 radially inward to clamp the lamp 12 therebetween. Thus the lower actuating arms 496 and 498 may be referred to as a control means, operably associated with center rod 404 and arms 478 and 480 for expanding and contracting fingers 422, 428 and 430.

From the position shown in FIG. 14, the upper actuating arms 478 and 480 once again move upward to their initial position as was first shown in FIG. 11. This ends the operation of the actuating arms at work station A and the lamp 12 is securely clamped within the lamp holder 7.

The next indexing motion of indexing arm 6 will then carry the lamp 12 to angular position P2 above work table 2.

Figure 16:
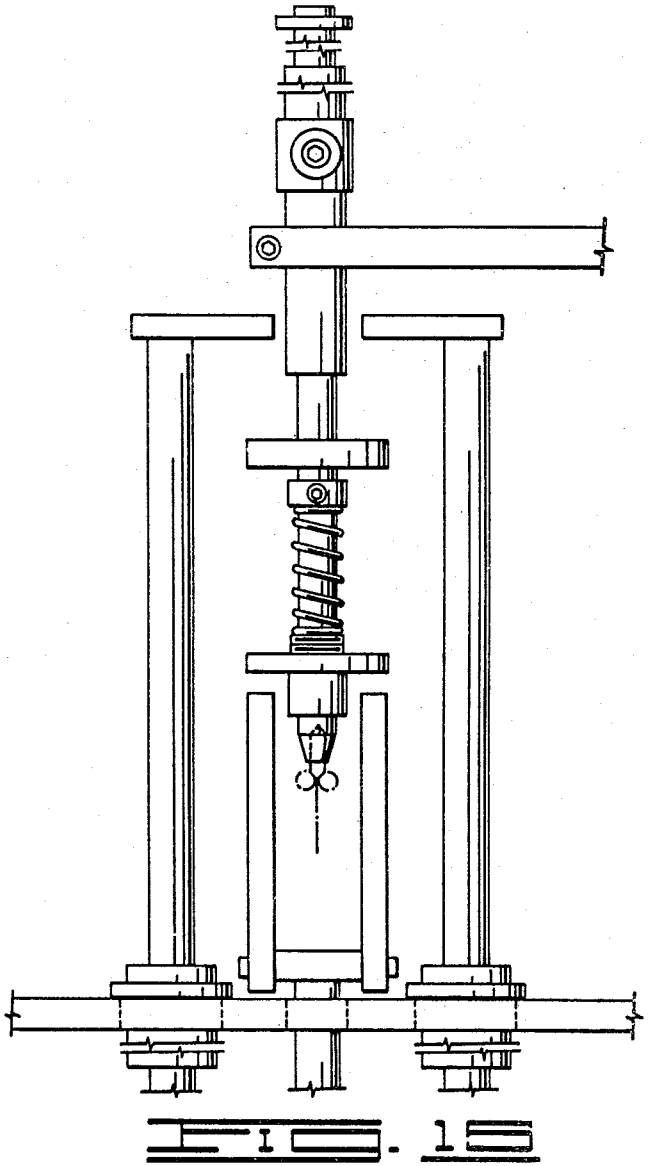
FIG. 16 is a plan view along line 16—16 of FIG. 11 showing the front end of the tapered alignment rollers with the associated structure of FIG. 11.

FIG. 16 is a plan view along line 16—16 of FIG. 11 which illustrates the relative orientation of the lamp alignment roller assembly 10 with the actuating apparatus just described.

In FIGS. 11–15, the center bore 416 of center rod 404 of lamp holder 7 is located directly above the forwardmost lamp 12A being held between the tapered alignment rollers 96 and 100.

As is shown in FIG. 16, the first and second spring wires 158 and 160, previously described with regard to FIG. 3, are placed directly in front of the forwardmost end of rollers 96 and 100 so as to hold the forwardmost lamp 12A between the rollers 96 and 100. After the lamp 12A has been clamped by the lamp holder 7, and when the indexing arm 6 moves toward second angular position P2, the lamp 12A is easily pulled between the spring wires 158 and 160.

The lamp 12 is releasably held within bore 416 of center rod 404 in a fixed position relative to center rod 404.

Separator-Cutter at Work Station B

The separator-cutter assembly located at work station B will now be described in detail. When lamp holder 7 indexes to work station B a lamp 12 is held in place therein as shown in FIG. 25 when viewed from a position radially outward from work station B facing inward towards the rotatable shaft 4.

It will be understood by those skilled in the art, that due to the handling of the lamps 12 prior to their positioning at work station B, the lead wires 32 and 34 will not necessarily be straight as shown in FIG. 25, but may for example be crossed as shown in FIG. 25A.

The separator and cutting apparatus at work station B will separate crossed wires such as shown in FIG. 25A and then trim the second lead wire 34 to a predetermined length as shown in FIG. 26.

Figure 31:
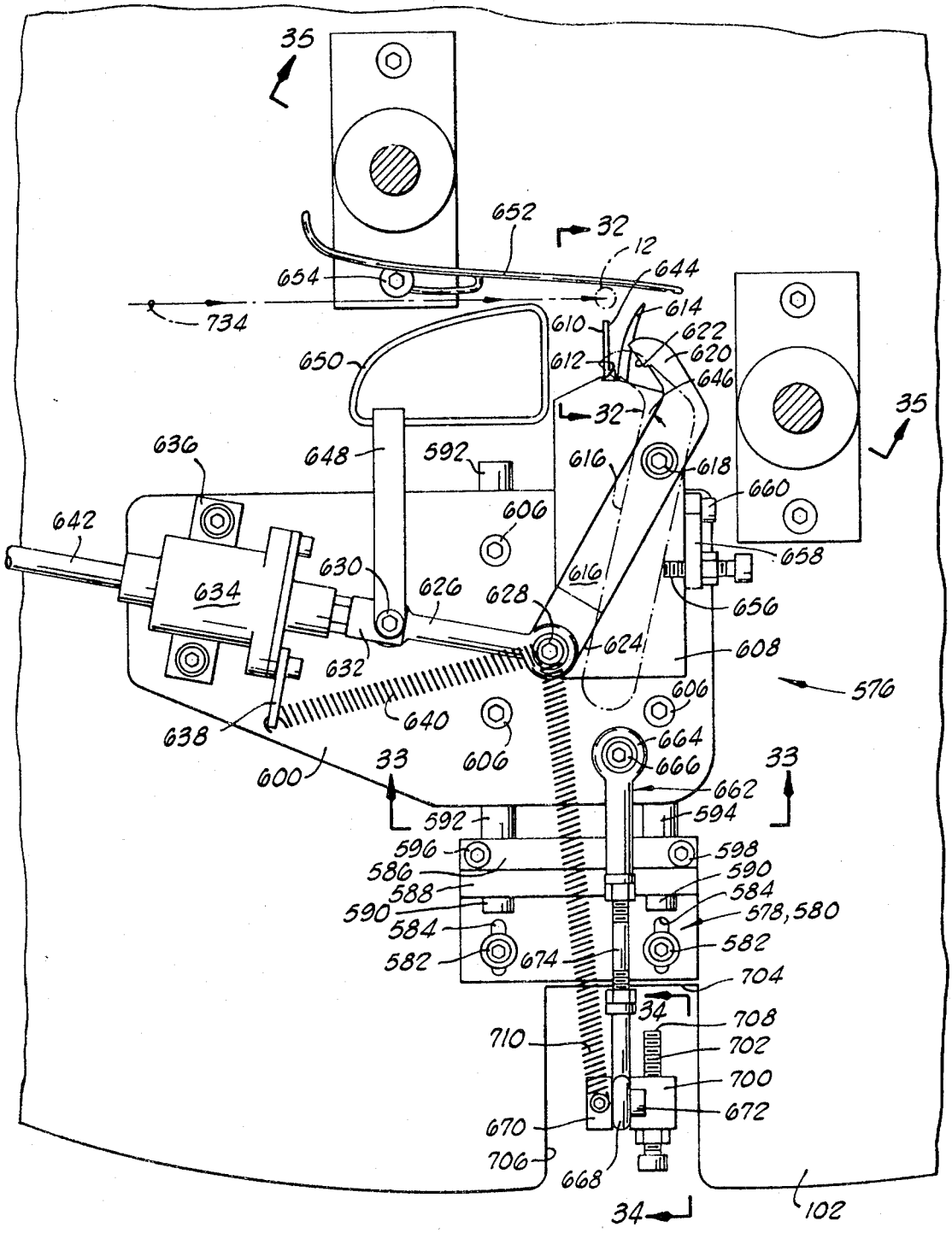
FIG. 31 is a plan view of the separator-cutter at work station B at angular position P3.

Referring to FIG. 31, the lamp lead wire separator-cutter is generally designated by the numeral 576. FIG. 31 is a plan view of the separator-cutter 576 mounted upon the table frame 2 at work station B at angular position P3 as seen in FIG. 1.

An angle-shaped mounting bracket 578 has a horizontal leg 580 attached to table frame 2 by allen screws 582 which extend through slots 584 into threaded holes in the table frame 2 so that the position of the mounting bracket 578 may be adjusted.

A rod holder plate 586 is attached to a vertical leg 588 of mounting bracket 578 by allen screws 590 which extend through vertical leg 588 into threaded bores in rod holder plate 586.

First and second parallel horizontally extending cylindrical rods 592 and 594 are attached to holder plate 586 by clamping within bores thereof by means of clamping screws 596 and 598 which tighten split (not shown) ends at each end of holder plate 586.

Figure 33:
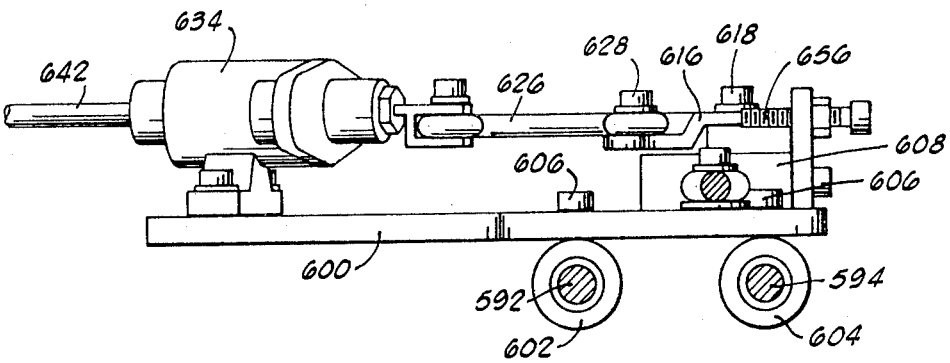
FIG. 33 is an elevation view along line 33—33 of FIG. 31, showing the apparatus attached to carrier plate 600.

A separator-cutter carrier plate 600 is slidably mounted upon rods 592 and 594 by means of cylindrical bushings 602 and 604 which are attached to carrier plate 600 by allen screws 606. The bushings 602 and 604 are best seen in FIG. 33, which is a sectional view along line 33—33 of FIG. 31.

Fixedly attached to carrier plate 600 is a cutter block 608. A separator blade 610 is mounted in a notch 612 in the innermost end of cutter block 608.

Also attached to the innermost end of cutter block 608 adjacent separator blade 610 is a lamp lead wire guide finger 614.

A cutter arm 616 is pivotally attached to the top surface of cutter block 608 by pivot screw 618. The innermost end of cutter arm 616 has a bent portion 620 which has a shearing edge 622 thereon.

The outermost end 624 of cutter arm 616 has a cutter actuating linkage 626 attached thereto by pivot screw 628. The other end of cutter actuating linkage 626 is pivotally attached at pivot screw 630 to a U-shaped bracket 632 attached to the end of a piston of an air cylinder 634. The air cylinder 634 is mounted upon separator-cutter carrier plate 600 by a mounting bracket 636. A spring attachment ear 638 extends outward from air cylinder 634, and a cutter return spring 640 is connected between ear 638 and pivot screw 628 on cutter arm 616.

Compressed air is supplied to air cylinder 634 by a hose 642.

When the separator-cutter 576 is in a position to trim one of the lead wires on a negative glow lamp, as will be further explained below, compressed air is directed to the cylinder 634 and the piston thereof is extended thereby moving linkage 626 and pivoting cutter arm 616 counterclockwise as seen in FIG. 31 about the pivot screw 618 so that the shearing edge 622 moves across a shearing edge 644 of separator blade 610 thereby cutting the second lead wire 34 of the lamp 12 between shearing edge 622 of cutter 616 and shearing edge 644 of separator blade 610. During that movement, the cutter arm 616 rotates through an angle 646 of approximately 10° as shown by the phantom lines defining the actuated position of cutter arm 616.

A bracket 648 is attached to U-shaped bracket 632 and extends inward. The inward end of bracket 648 has an outer lamp lead wire guide frame 650 attached thereto. As is further discussed below, the outer guide frame 650 assists in the proper positioning of the lamp lead wires.

An inner lead wire guide frame 652 is attached to table frame 2 by mounting bolt 654.

When cutter arm 616 is pivoted to the cutting position shown in phantom lines in FIG. 31, the counterclockwise motion of cutter arm 616 is limited by engagement of the cutter arm 616 with an adjustable bolt 656 which is attached to an adjustment holder frame 658 which is in turn attached to cutter block 608 by allen screws such as 660.

Attached to separator-cutter carrier plate 600 is a separator actuating linkage 662. Separator actuating linkage 662 has an innermost end 664 which is attached to the carrier plate 600 by pivot screw 666.

Separator actuating linkage 662 includes an outer end 668 which is attached to a vertical actuating bar 670 by an allen screw 672.

Separator actuating linkage 662 further includes a middle portion 674 connected to the inner and outer ends 664 and 668 by oppositely oriented threads so that the length of linkage 662 may be adjusted by rotation of the middle part 674.

Figure 34:
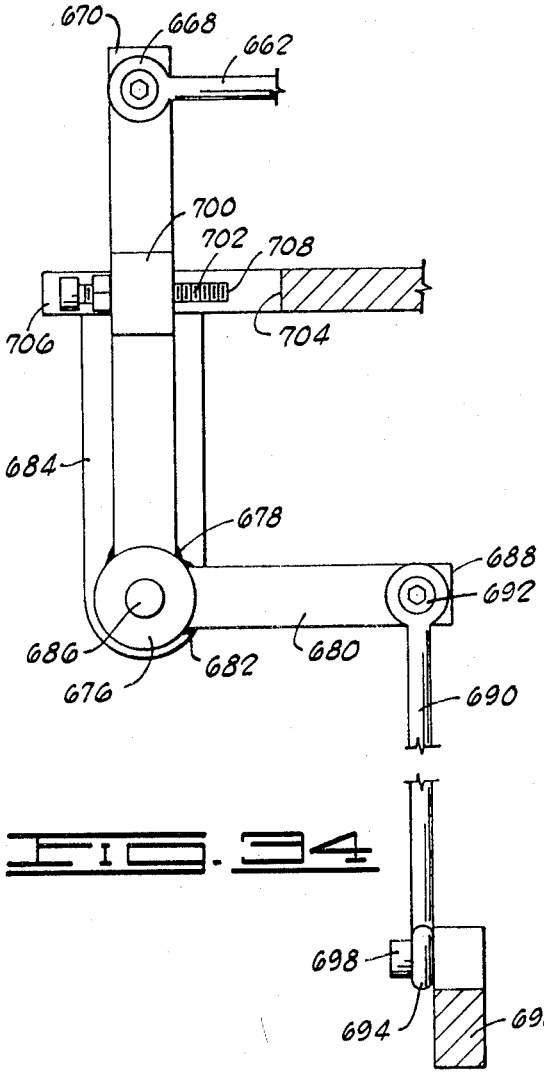
FIG. 34 is an elevation view along line 34—34 of FIG. 31, showing an actuating linkage for moving carrier plate 600.

In FIG. 34, which is a section elevation view along line 34—34 of FIG. 33, the vertical actuating bar 670 is better shown. Actuating bar 670 is rigidly attached to a cylindrical pivot sleeve 676 at weld 678. A horizontal arm 680 is also rigidly attached to pivot sleeve 676 at weld 682. Pivot sleeve 676 is pivotally attached to a downward extending support bracket 684 by pivot pin 686. An inner end 688 of horizontal arm 680 is attached to a vertical linkage 690 at pivot pin 692. A lower end 694 of vertical linkage 690 is attached to an actuating bar 696 by pivot screw 698.

The actuating bar 696 has one end (not shown) pivotally attached to the supporting framework 3 of table frame 2, and is moved up and down in a pivotal motion by a cam (not shown) attached to a primary camshaft (not shown) which coordinates the movement of all the various components of automatic welding turntable 1.

An adjustment holder block 700 is attached to the forward side of vertical actuating bar 670 and has an adjustment bolt 702 disposed therethrough for engagement with a radially innermost edge 704 of a cut out portion 706 of the table frame 2. Engagement of an inner end 708 of adjustment bolt 702 with edge 704 limits radially inward movement of separator actuating linkage 662.

A coil tension spring 710 is connected between an upper end of vertical actuating bar 670 and the pivot pin 628 on cutter arm 616 to merely take the slack out of the linkage connected to separator actuating linkage 662.

Referring now to FIG. 35, a section elevation view along line 35—35 of FIG. 31 shows length adjustment arms 712 and 714 arranged for engagement with the lower retaining ring 410 of lamp holder 7.

As previously described, the center rod 404 of lamp holder 7 is friction fit within a friction tube 400 so that its vertical position is maintained once it is moved vertically within the friction tube.

When the lamp holder 7 reaches angular position P3 it is in the same position at which it left angular position P1 so that the lower retaining ring 410 is located a considerable distance below the lower end 414 of friction tube 400.

Figure 32:
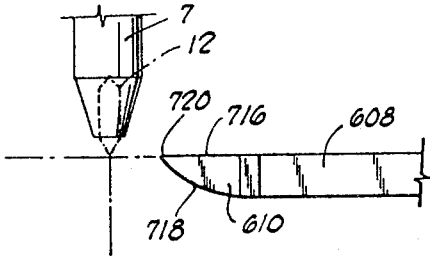
FIG. 32 is an elevation view along line 32—32 of FIG. 31 showing the separator blade in relation to a lamp.

As is best shown in FIG. 32, which is a view along line 32—32 of FIG. 31, the separator blade 610 is located at an elevation such that a top surface 716 thereof is located only slightly below the bottom tip of the glass bulb 14 of the lamp 12 carried by lamp holder 7.

Shearing edge 644 is defined on the right side (as viewed in FIG. 31) of top surface 716. Blade 610 has a curved lower surface 718 which meets top surface 716 at a tip 720. When the lamp 12 is held at angular position P3, the carrier plate 600 moves inward on slide rods 692 and 694 and blade 610 is inserted tip first between lead wires 32 and 34 thereby separating the same.

The adjustment of the length to which the second lamp lead wire is to be cut may then be made by raising the entire lamp holder center rod 404 within its friction tube 400 by means of the length adjustment arms 712 and 714 which engage lower retaining ring 410 on its bottom surface.

Length adjustment arms 712 and 714 are attached to the upper ends of actuating rods 722 and 724, the lower ends of which are commonly attached to a cross member 726. Thus, the arms 712 and 714 are maintained at identical elevations. The cross member 726 is attached to an adjustable length vertical linkage 728 which is pivotally attached at pivot pin 730 to a second horizontal actuating bar 732 which is pivotally attached to the support frame 3 of table frame 2 in a manner similar to that previously described for bar 696 and which is also driven by the main camshaft as also previously described for bar 696. The length to which the second lead wire 34 of lamp 12 is to be cut may be adjusted by adjusting the length of vertical linkage 728, thereby adjusting the height to which the length adjustment arms 712 and 714 are carried.

Operation of the Separator-Cutter

The general manner of operation of the separator-cutter 576 is as follows.

When the indexing arm 6 and lamp holder 7 carry a lamp 12 from the angular position P2 to position P3, it travels through a path approximately along the line 734 shown in FIG. 31 to a position as shown in phantom lines for the lamp 12 when the indexing arm is stopped at angular position P3. Initially, the separator-cutter 576 is in the position illustrated in FIG. 31. The lamp holder 7 is at the same elevation at which it left angular position P1. The length adjustment arms 712 and 714 are at a lowermost position out of contact with and below the lower retaining ring 410 of lamp holder 7.

As the lamp 12 moves through the path 734, the lead wires 32 and 34 thereof, if the same happened to be bent radially inward or outward from the lamp 12, are guided toward a vertically downward position by engagement with the inner and outer lamp lead wire guide frames 652 and 650. If the lamp lead wires are bent in a forward direction from the lamp 12, they will engage lamp wire guide finger 614 which extends inward from cutter block 608 so as to also guide the lamp lead wires toward a vertically downward position from the lamp 12.

Once the lamp 12 is stopped at angular position P3, the horizontal actuating bar 696 shown in FIG. 34 is moved downward by the main camshaft thereby pulling vertical link 690 downward and pivoting horizontal arm 680 and vertical actuating arm 670 clockwise as shown in FIG. 34 about pivot pin 686. This pushes the separator actuating linkage 662 radially inward as seen in FIG. 31 so that separator-cutter carrying plate 600 slides inward upon the parallel bars 592 and 594 thereby moving the separator blade 610 inward between the lead wires 32 and 34 of lamp 12.

After separator blade 610 has been inserted between the lamp lead wires 32 and 34, the horizontal actuating bar 732 (see FIG. 35) moves upward thereby moving the actuating rods 722 and 724 and their accompanying length adjustment arms 712 and 714 upward into engagement with the lower retaining ring 410 of lamp holder 7 thereby moving the center rod 404 of lamp holder 7 upward within the friction tube 400 to a desired position such that shearing edge 644 of separator blade 610 is adjacent a point at which second lead wire 34 is to be cut. The lamp lead wires 32 and 34 are still located on opposite sides of separator blade 610.

Then a micro-switch (not shown) is actuated by the primary camshaft (not shown) and opens a solenoid valve (not shown) to direct compressed air to air cylinder 636 causing cutter arm 616 to pivot to the position shown in phantom lines in FIG. 31, thereby trimming the second lamp lead wire 34 to a desired length as shown in FIG. 26.

Then the length adjustment arms 712 and 714 move downward out of engagement with the lamp holder 7 and the micro-switch opens closing the solenoid valve thereby cutting off the supply of air to cylinder 634 which allows return spring 640 to rotate cutter arm 616 back to the position shown in solid lines in FIG. 31. At the same time, the separator-cutter carrier plate 600 is moved radially outward along the parallel rods 592 and 594.

That completes the work cycle at work station B at angular position P3 and the lamp 12 is then ready to be moved to the next work station.

Work Station C

At work station C at angular position P5 a pair of actuating arms similar to length adjustment arms 712 and 714 of FIG. 35 engage lower retaining ring 410 from below and push center rod 404 upward relative to friction tube 400 until retaining ring 410 nearly abuts lower end 414 of friction tube 400.

Work Station D

Figure 36:
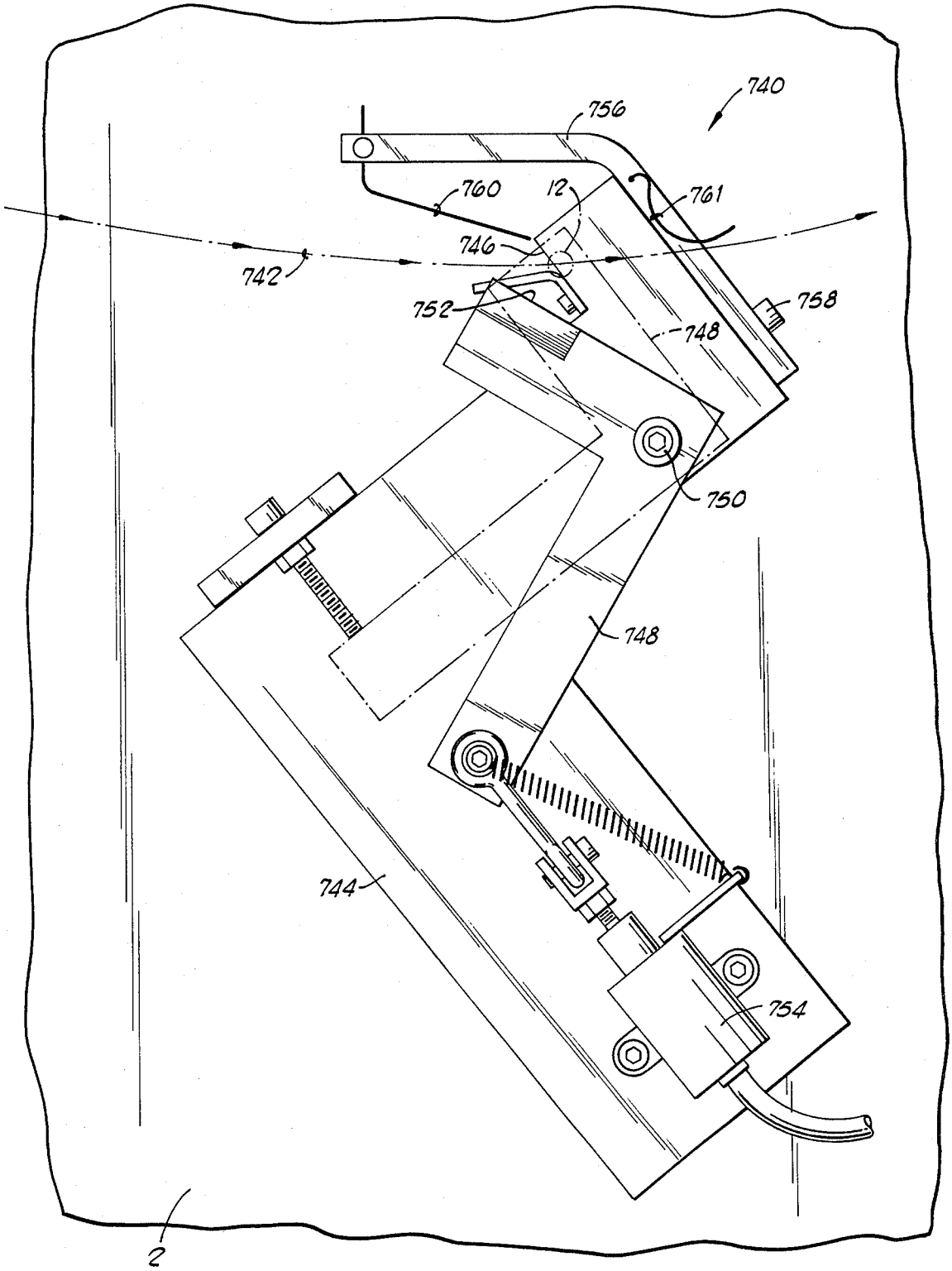
FIG. 36 is a plan view of a cutter mechanism at work station C at angular position P5.

At work station D at angular position P6 a lead wire cutter 740, illustrated in FIG. 36, is mounted on table frame 2. In traveling from position P5 to position P6, the lamp 12 is carried through a path 742 to the position illustrated in phantom lines in FIG. 36. There the first lead wire 32 may, if desired, be trimmed to the configuration shown in FIG. 26A.

Cutter 740 includes a frame plate 744 attached to table frame 2. A first shearing edge 746 is defined on frame plate 744. A cutter arm 748 is pivotally attached to frame plate 744 at pivot pin 750 and has a second shearing edge 752 defined thereon.

When lamp 12 is held at the position shown in phantom lines in FIG. 36, the cutter arm 748 is moved to the position shown in phantom lines by an air cylinder 754, thus trimming first lead wire 32.

A bracket 756 is attached to frame plate 744 by screw 758, and carries a guide wire 760 for guiding lead wire 32 into position to be cut.

A second guide wire 761 guides lead wire 32 toward a next desired orientation as it moves away from position P6 toward position P7.

Work Station E

At work station E at angular position P7, an apparatus is provided for straightening second lead wire 34 prior to welding, and for bending first lead wire 32 out of the way so that the lamp 12 has the appearance shown in FIG. 27 when it leaves work station E.

Figure 38:
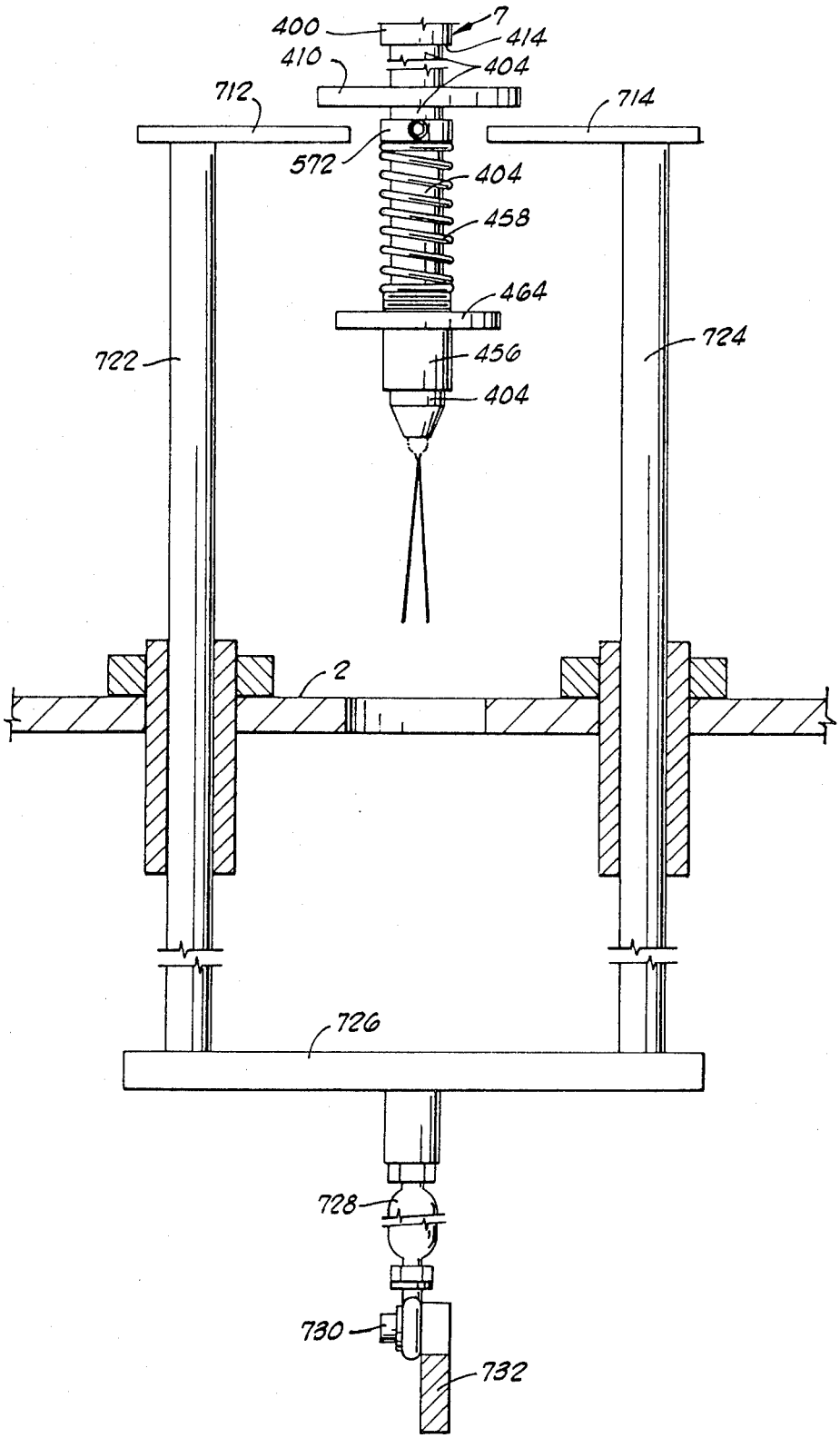
FIG. 38 is a front elevation view along line 38—38 of FIG. 37.
Figure 37:
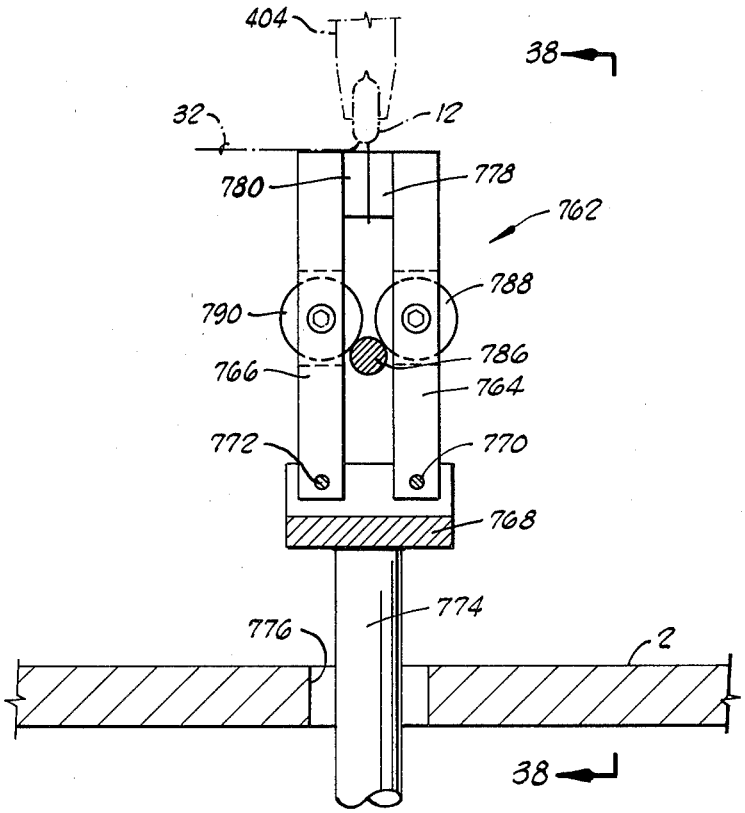
FIG. 37 is an elevation view of a lead wire straightening mechanism at work station D at angular position P6.
Figure 38:
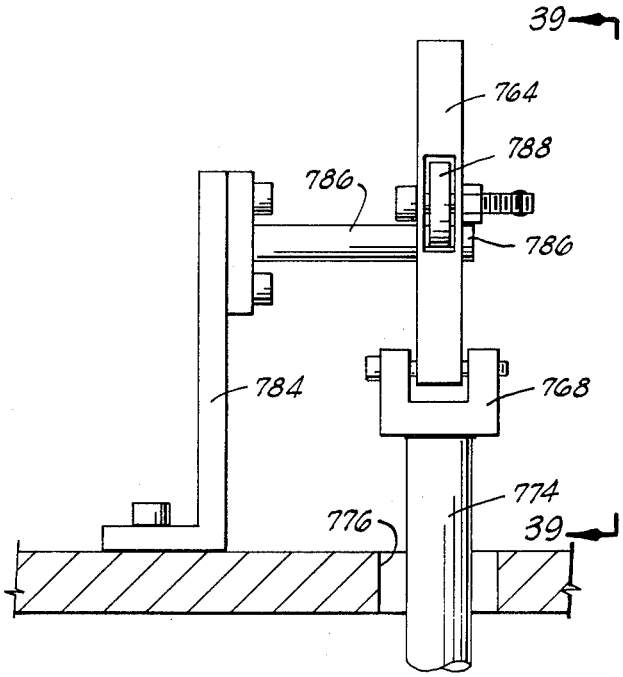
Figure 39:
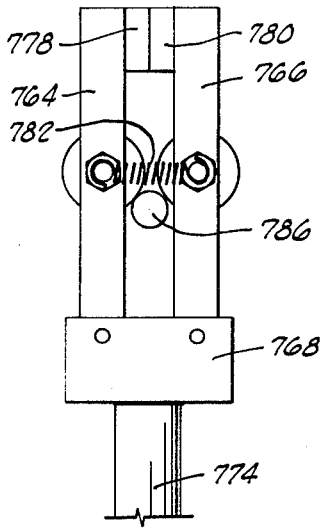
FIG. 39 is a rear elevation view along line 39—39 of FIG. 38.

In FIG. 37, a lead wire straightening apparatus is shown and generally designated by the numeral 762. FIG. 37 is an elevation view looking radially inward toward center shaft 4. FIG. 38 is a front side elevation view along line 38—38 of FIG. 37. FIG. 39 is an elevation view looking radially outward along line 39—39 of FIG. 38.

Straightening apparatus 762 includes front and rear vertical arms 764 and 766 pivotally attached to a U-shaped bracket 768 by horizontal pins 770 and 772. Bracket 768 is attached to the top of a vertically reciprocable rod 774 extending upward through a hole 776 in table frame 2.

Arms 764 and 766 have pads 778 and 780 attached to their respective upper ends for clamping second lead wire 34 therebetween to straighten the same. A coil spring 782, best seen in FIG. 39, biases arms 764 and 766 toward each other.

A bracket 784 is attached to table frame 2 radially outward of rod 774, and has a horizontal radially inward extending rod 786 attached thereto. Rod 786 extends between arms 764 and 766. Arms 764 and 766 include rollers 788 and 790 for engaging rod 786.

When lamp 12 is moved to angular position P7, it is in the position shown in phantom lines in FIG. 37. Its first lead wire 32 is bent somewhat rearward due to engagement with the upper surface of cutter frame plate 744 of FIG. 36 as the lamp 12 was carried from position P6 to position P7.

The straightening apparatus 762 is initially in a lowermost position relative to table frame 2, with rollers 788 and 790 located below rod 786. Pads 778 and 780 are clamped together by spring 782.

Rod 774 then moves upward relative to table frame 2, and as rollers 788 and 790 move level with rod 786 the arms 764 and 766 are spread apart. When the rollers 788 and 790 move upward past rod 786 the spring 782 pulls arms 764 and 766 back together and second lead wire 34 is clamped between pads 778 and 780 thereby straightening lead wire 34. Lead wire 32 is engaged by the upper end of rear arm 766 and bent upward.

Then rod 774 moves back down, releasing lead wire 34 and the operation at work station E is complete.

Work Station F

At work station F at angular position P12, a sensor determines whether a lamp 12 is present within the lamp holder 7 carried by the indexing arm 6 which is then located at angular position P12. If no lamp is present the operation described below for work station G is eliminated at the next angular step movement of shaft 4, so as to prevent the wasting of resistors 35.

Just prior to this, at angular position P11, a safety switch checks the vertical position of lamp holder 7 to be sure it will clear work station G at angular position P13.

Work Station G - Welding Machine

At angular position P13, the work station G of FIG. 1 includes a means for welding one of the resistors 35, which is supplied to work station G by the resistor feeder means 42, to the second lead wire 34 of each of the lamps 12. As the lamp 12 leaves angular position P13, it has the appearance illustrated in FIG. 28. The following is a description of the welding machine located at work station G, which welds the resistors 35 to the lamps 12.

Figure 40:
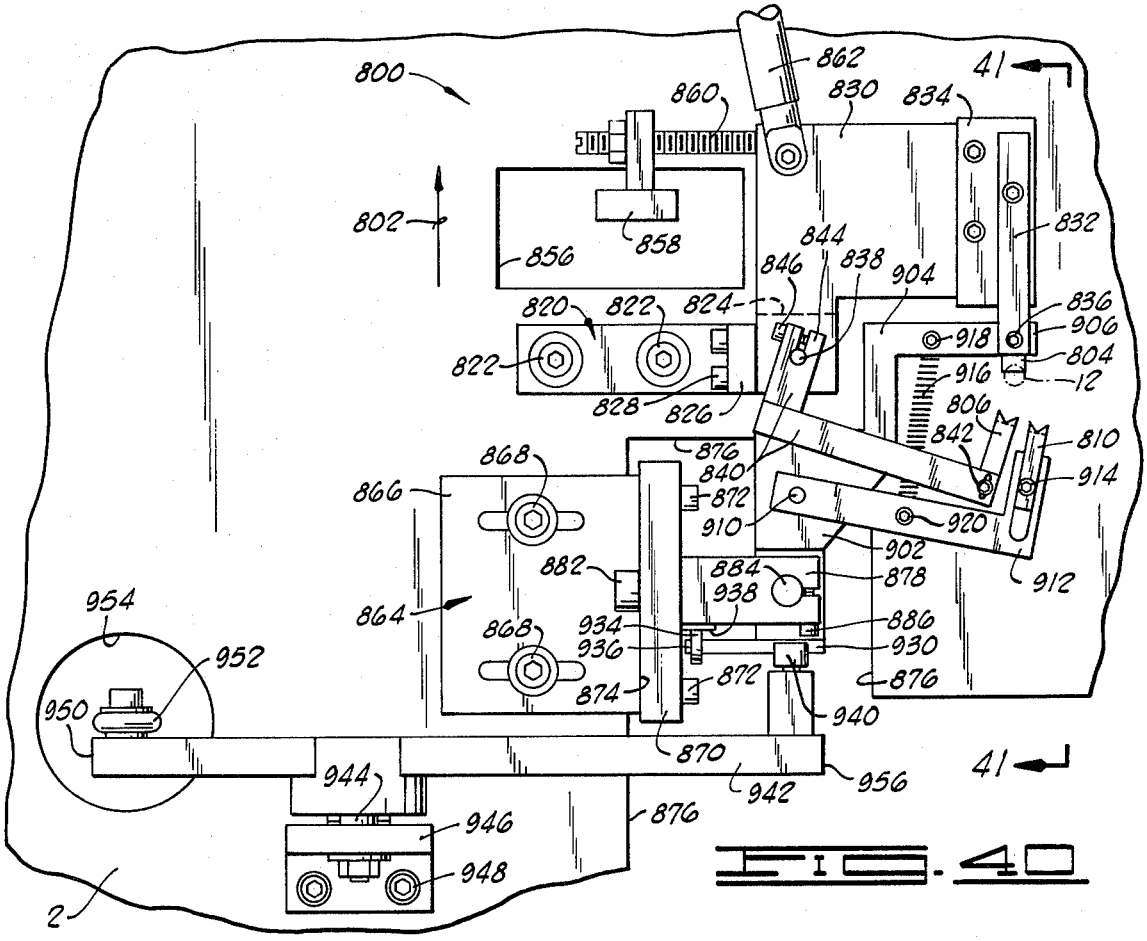
FIG. 40 is a plan view of a welding machine at work station G at angular position P13.

Referring now to FIG. 40, an automatic welding machine generally designated by the numeral 800 is mounted upon table frame 2. An arrow 802 points radially inward toward center shaft 4 for purposes of orientation of FIG. 40 for the viewer.

When a lamp 12 is first moved to angular position P13, it is oriented in plan view at the position in phantom lines in FIG. 40, and it has a structure such as that shown in FIG. 27, with the second lead wire 34 pointed vertically downward and having been cut to a relatively short length.

Automatic welding machine 800 includes an upper jaw assembly having an upper electrode 804 and an upper V-shaped jaw 806 for clamping lead wire 34 of lamp 12 therebetween and directing electrical current thereto.

Automatic welding machine 800 also includes a lower jaw assembly having a lower electrode 808 (see FIG. 41) and lower V-shaped jaw 810 for clamping an upper lead wire 47 of resistor 35 therebetween and conducting an electrical current thereto.

Figure 43:
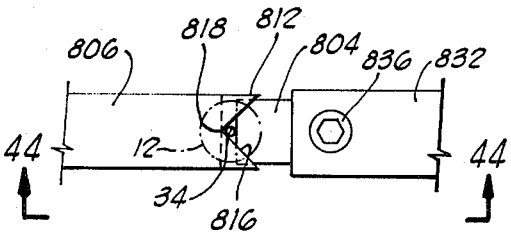
FIG. 43 is a plan view of the upper V-jaw assembly of the welding machine of FIG. 41.
Figure 44:
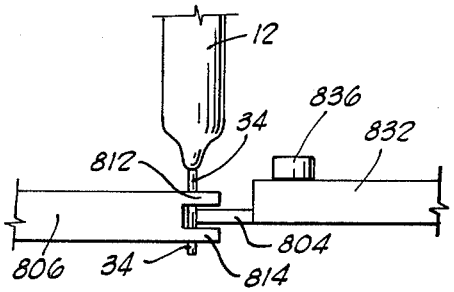
FIG. 44 is a front elevation view along line 44—44 of FIG. 43.

The details of construction of upper electrode 804 and the upper V-shaped jaw are best shown in FIGS. 43 and 44. FIG. 43 is an enlarged plan view of electrode 804 and upper V-shaped jaw 806 brought together about second lamp lead wire 34 of a lamp 12.

The electrode 804 is a flat rectangular member as can be seen in FIGS. 43 and 44.

The V-shaped jaw 806 has upper and lower flange portions 812 and 814 between which the electrode 804 is received when the electrode 804 and V-shaped jaw 806 are engaged with the lamp lead wire 34. Both upper and lower flanges 812 and 814 have a V-shaped notch such as 816 in the end thereof. Thus, when lamp lead wire 34 is located between electrode 804 and V-shaped jaw 806, and V-shaped jaw 806 is moved into engagement with the end of electrode 804 as shown in FIGS. 43 and 44, the V-shaped notches 816 guide the lamp lead wire 34 to the root 818 of notches 816 so as to define the position of lamp lead wire 34.

As is further explained below, the upper electrode 804 and the lower electrode 808 remain fixed during the operation at work station G and the upper and lower V-shaped jaws 806 and 810 move into engagement with the electrodes 804 and 808. The electrodes 804 and 808 are vertically aligned so that the electrode 804 is directly above the electrode 808. When the upper and lower V-shaped jaws 806 and 810 are moved into engagement with electrodes 804 and 808, respectively, they similarly are vertically aligned so that the V-shaped notch 816 in upper jaw 806 is oriented directly above the V-shaped notch in lower jaw 810. Thus, the lamp lead wire 34 will be oriented directly above resistor lead wire 47 so that a subsequent vertical upward movement of the lower jaw assembly will engage the butt ends of lamp lead wire 34 and resistor lead wire 47 so that a weld therebetween may be created by passing a current through the lead wires 34 and 47.

The V-shaped jaws just described provide a means for automatically aligning the lead wires 34 and 47 for welding.

Figure 42:
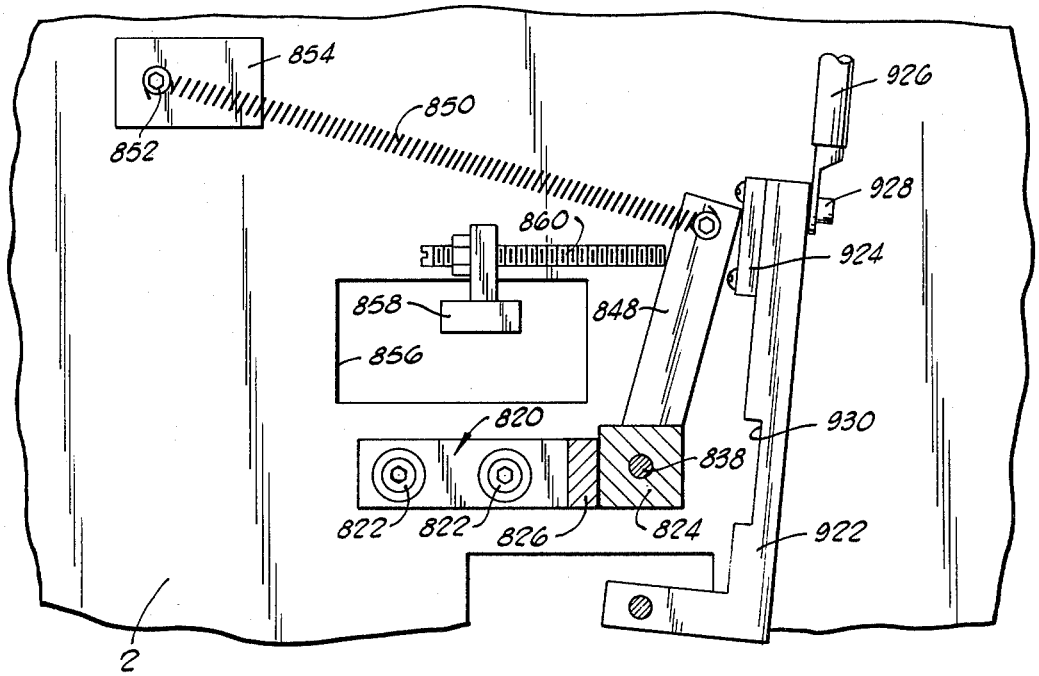
FIG. 42 is a plan view along line 42—42 of FIG. 41.

Referring again to FIG. 40, the mounting structure for the upper and lower jaw assemblies will now be described. An upper jaw assembly mounting bracket 820 has a horizontal leg attached to table frame 2 by allen screws 822. A mounting block 824 best seen in FIG. 42 is attached to a vertical leg 826 of mounting bracket 820 by mounting screws 828.

A horizontal plate 830 is fixedly attached to the top of mounting block 824.

An upper electrode holder 832 is attached to a spacer plate 834 which in turn is mounted on horizontal plate 830.

The upper electrode 804 is mounted within holder 832 and is adjustable therein by means of adjustment screw 836. Extending vertically upward through mounting block 824 is a pivotable rod 838. Attached to the upper end of rod 838 is an upper V-jaw holder 840 to which upper V-jaw 806 is adjustably attached by screw 842. A short arm 844 of upper V-jaw holder 840 has a split end which is clamped about the upper end of pivot rod 838 by means of clamping screw 846.

As is best shown in FIG. 42, there is attached to the lower end of pivot rod 838 for pivotation therewith, an upper V-jaw actuating arm 848. When actuating arm 848 is pivoted, as will be further described below, the pivot rod 838 and the upper V-jaw holder 840 pivot therewith, thereby moving the upper V-jaw 806 into and out of engagement with the upper electrode 804 in the manner previously described with regard to FIGS. 43 and 44.

An upper V-jaw return spring 850, which is a coil tension spring, is connected between actuating arm 848 and a mounting pin 852 which is physically attached to table frame 2 by an insulated mounting assembly 854.

Extending upward through a hole 856 disposed in table frame 2 is a vertical actuating arm 858 which has an adjustable bolt 860 extending therefrom toward upper V-jaw actuating arm 848. The vertical actuating arm 858 is driven by a suitable linkage engaged with the main camshaft of the automatic welding turntable 1 so that the movement thereof is synchronized with the other components of the automatic welding turntable 1.

When it is desired to move the upper V-jaw 806 into engagement with the upper electrode 804, the vertical actuating arm 858 moves to the left, as seen in FIG. 42, thereby allowing return spring 850 to pivot upper V-jaw actuating arm 848, pivot rod 838 and upper V-jaw holder 840 counterclockwise about the vertical axis of rod 838, thereby moving upper jaw 806 into engagement with upper electrode 804.

The upper V-jaw 806 is moved out of engagement with electrode 804 by moving vertical actuating arm 858 to the right toward upper V-jaw actuating arm 848 to the position shown in FIG. 42.

A hot electrical lead wire 862 is attached to horizontal plate 830 which is electrically connected to upper electrode 804 and upper V-jaw 806. Thus, it is necessary that the mounting bracket 820 for upper V-jaw assembly be insulated from the table frame 2.

A lower V-jaw assembly mounting bracket 864 has a horizontal plate 866 adjustably mounted upon table frame 2 by allen screws 868. Bracket 864 also includes a vertical plate 870 adjustably attached to horizontal plate 866 by allen screws 872.

Figure 41:
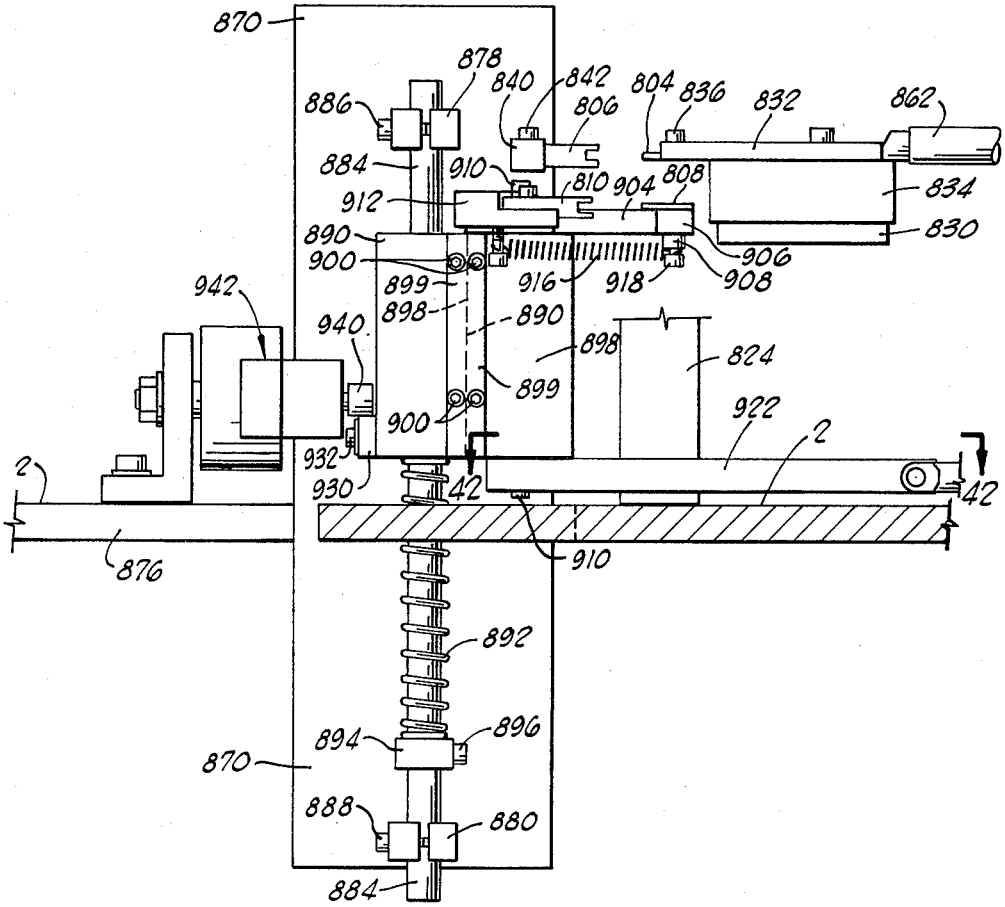
FIG. 41 is a front elevation view along line 41—41 of FIG. 40.

As is best seen in FIGS. 40 and 41, a forward end 874 of horizontal plate 866 extends slightly over a cut out 876 in table frame 2 and vertical plate 870 extends vertically both above and below table frame 2.

Extending horizontally forward from vertical plate 870 are horizontal bars 878 and 880 which are attached to vertical plate 870 by allen screws such as 882. A vertically oriented cylindrical carrier rod 884 is fixedly clamped within split forward ends of bars 878 and 880 by clamping screws 886 and 888.

A sliding block 890 has a vertical bore therethrough within which is closely received the carrier rod 884 so that block 890 slides vertically along carrier rod 884. The sliding block 890 is supported from below by a coil compression spring 892 disposed about carrier rod 884 and having its lower end resting on an adjustable collar 894 which is fixed to carrier rod 884 by a set screw 896.

As is best seen in FIG. 41, a second block 898 is attached to sliding block 890 by overlapping plates such as 899 which overlap the adjacent forward and rearward edges of sliding block 890 and second block 898 and are attached thereby by screws 900.

Second block 898 has a horizontal plate 902 (see FIG. 40) fixedly attached to the top thereof, which plate 902 includes an L-shaped horizontal extension 904. A forwardmost end 906 of L-shaped extension 904 has the lower electrode 808 attached thereto by an adjustment screw 908 as is best seen in FIG. 41.

Extending vertically through second block 898 and through horizontal plate 902 is a second pivot rod 910 to the upper end of which is attached a lower V-jaw holder 912. The lower V-jaw 810 is attached to lower V-jaw holder 912 by an adjustable screw 914.

A lower V-jaw return spring 916, which is a coil tension spring, is connected between a pin 918 on extension 904 of horizontal plate 902 and a pin 920 attached to lower V-jaw holder 912.

As is best seen in FIG. 41, there is fixedly attached to the lower end of second pivot rod 910, for pivotation therewith, a lower V-jaw actuating arm 922.

As shown in FIG. 42, when the upper V-jaw actuating arm 848 is pushed forward by adjustable screw 860 attached to vertical actuating arm 858, the upper V-jaw actuating arm 848 engages an insulating board 924 attached to the inner end of lower V-jaw actuating arm 922, so as to push the inner end of lower V-jaw actuating arm 922 forward thereby pivoting second pivot rod 910 about its vertical axis to move lower V-jaw 810 out of engagement with lower electrode 808.

When the vertical actuating arm 828 is moved to the left within slot 856, the lower V-jaw return spring 916 pivots second pivot rod 910 and lower V-jaw holder 912 counterclockwise as shown in FIG. 40 about the vertical axis of second pivot rod 910 thereby moving lower V-jaw 810 into engagement with lower electrode 808.

As seen in FIG. 42, a ground wire 926 is electrically connected to lower V-jaw actuating arm 922 by a screw 928.

The ground wire 926 and hot wire 862 are both connected to an electrical transformer (not shown) which directs a current thereto for welding the butt ends of lead wire 34 from lamp 12 and lead wire 47 from resistor 35 at the appropriate time.

Lower V-jaw actuating arm 922 includes a cut out 930 for fitting about the forward side of mounting block 824.

Referring again to FIG. 41, the sliding block 890 has a horizontal roller engagement bar 930 attached thereto by screws 932.

As is seen in FIG. 40, a guide roller 934 is rotatably attached to the back side of bar 930 by a screw 936. The guide roller 934 engages a guide surface 938 extending forwardly from vertical plate 870 of mounting bracket 864.

An actuating roller 940 engages the upper surface of horizontal bar 930. Roller 940 is rotatably attached to a horizontally extending pivoted linkage 942, a middle part of which is pivotally mounted upon a pivot bar 944 extending horizontally from a bracket 946 attached to table frame 2 by mounting screws 948.

A rear end 950 of horizontal pivoted bar 942 is attached to a vertical linkage 952 which extends upwardly through a hole 954 in table frame 2. The vertical linkage 952 is connected to suitable linkage driven by the main camshaft from automatic welding turntable assembly 1, so as to cause the rear end 950 to move downward at such time as it is desired to move the lead wire 47 of resistor 35 upward into engagement with the lead wire 34 from lamp 12.

Downward motion of rear end 950 allows the forward end 956 of bar 942 to move upward, and the roller 940 engaging roller engagement bar 930 therefore moves upward allowing sliding block 890 to be moved upward by coil compression spring 892.

The lower V-jaw assembly is carried upward with sliding block 890 thereby carrying the resistor 35 upward so that its lead wire 47 butts against the lead wire 34 from lamp 12. Those lead wires have previously been vertically aligned by the upper and lower jaw assemblies.

The upward force exerted upon resistor 35 is determined by the compression of coil compression spring 892.

When the lead wires 34 and 47 are butted together, the transformer (not shown) directs an electric current therethrough and the butt weld 43 shown in FIGS. 28–30 is formed.

Work Station G - Resistor Feeder

The resistors 35 are fed to the welding machine 800 at work station G by resistor feeder 42, shown schematically in FIG. 1. The resistor feeder 42 includes a conveyor 960, and a loader 962. The loader 962 loads resistors 35 onto conveyor 960 which carries the resistors 35 to a lead wire cutter 964 and then to the welding machine 800.

Figure 45:
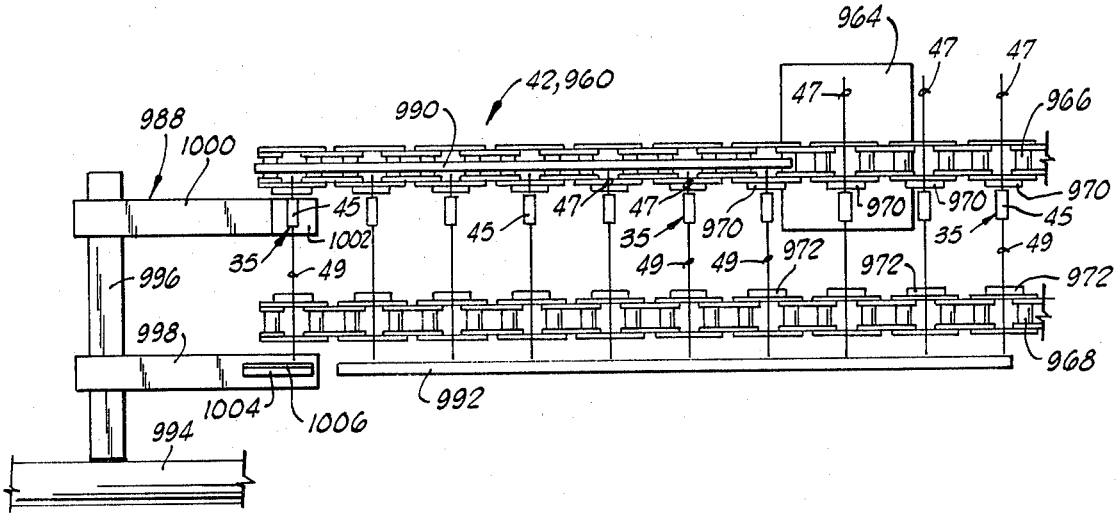
FIG. 45 is a plan view of a resistor conveyor of resistor feeder 42 at work station G at angular position P13.

The conveyor 960 is shown in plan view in FIG. 45. The loader 962 and the outer end of conveyor 960 are shown in elevation in FIG. 46.

Referring to FIG. 45, conveyor 960 includes two parallel endless roller chains 966 and 968 which carry pairs of opposed notched plates 970 and 972 for receiving lead wires 47 and 49, respectively, of resistors 35.

Figure 46:
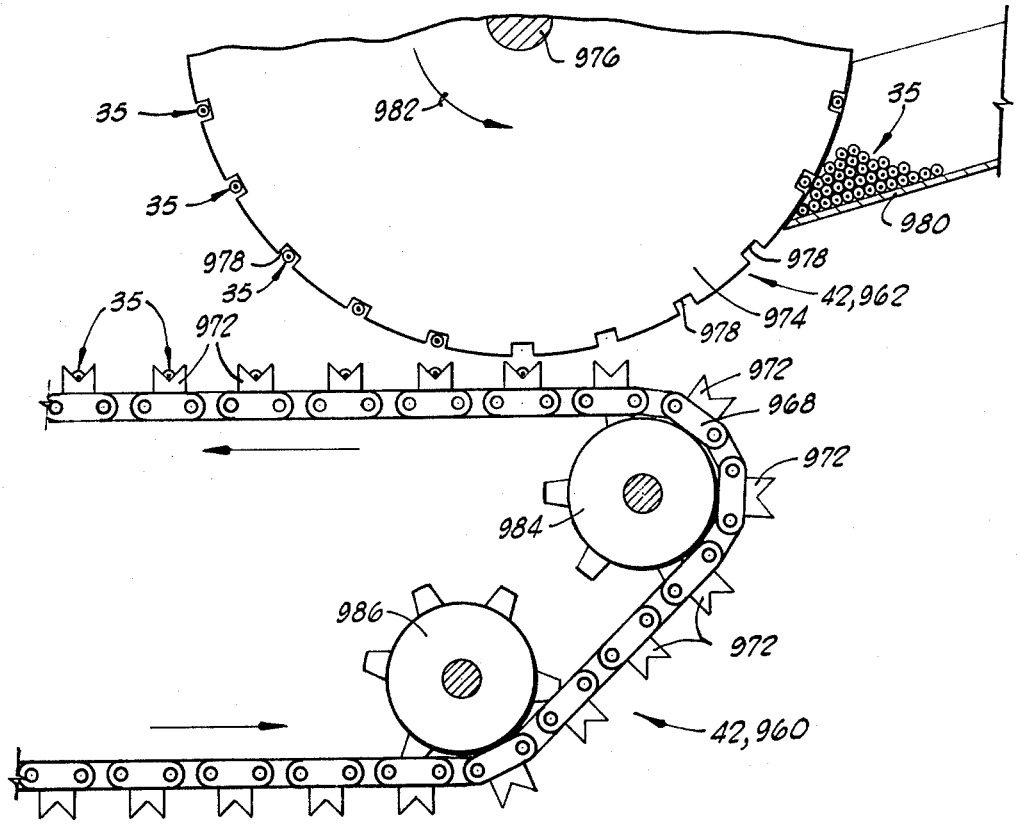
FIG. 46 is an elevation view of a resistor loader and the outer end of the resistor conveyor of FIG. 45.

Referring to FIG. 46, which is somewhat schematic, a feeder disc 974 rotates with a horizontal shaft 976. Disc 974 includes a plurality of notches 978 in its radially outer surface for holding the bodies 45 of resistors 35. An inner passage (not shown) within disc 974 communicates notches 978 with a vacuum source.

An inclined chute 980 is filled with resistors 35 which are oriented horizontally and stacked like cordwood in chute 980.

Disc 974 rotates in the direction indicated by arrow 982 and engages the stack of resistors 35 in chute 980. The notches 978 are communicated with vacuum as they pass chute 980 so that one of the resistors 35 is received within each notch 978 and held therein due to the internal vacuum of disc 974.

The outer end of conveyor 960 is located below disc 974 and their movements are coordinated, so that when each notch 978 traverses its lowest point of circular travel a pair of notched plates 970 and 972 is located below the notch 978. At its lowest point of circular travel the vacuum to each notch 978 is broken so that the resistor 35 is dropped therefrom and is caught by the notched plates 970 and 972.

The conveyor 960 is moving to the left on sprockets such as 984 and 986.

Conveyor 960 carries each resistor to a cutter 964 (see FIG. 45) where the lead wire 47 is trimmed. Then the resistor 35 continues to the left until it is received by a transfer carriage 988. Between cutter 964 and transfer carriage 988 are vertical side walls 990 and 992 which keep resistors 35 properly positioned for receipt by transfer carriage 988.

Transfer carriage 988 includes a rotatable horizontal shaft 994 from which a bar 996 extends. Arms 998 and 1000 extend perpendicularly from bar 996 parallel to shaft 994.

Located on the outer end of arm 1000 is a V-shaped saddle 1002 for receiving body 45 of resistors 35. On the outer end of arm 998 is an angle 1004 having a flange 1006 extending upward from arm 998, for supporting lead wires 49.

As each resistor 35 reaches the leftmost end of conveyor 960, the transfer carriage 988 pivots upward from below conveyor 960 thereby carrying one of the resistors 35 to a vertically oriented position where the upper lead wire 47 thereof is clamped between the lower V-jaw 810 and the lower electrode 808 of FIG. 41. It is then welded to one of the lamps 12 as previously described.

Work Station H

At work station H at angular position P16, a cutter trims the lower lead wires 49 of resistors 35 so that the lamp 12 has the appearance shown in FIG. 29 when it leaves angular position P16. The cutter at work station H is similar to the cutter of work station D shown in FIG. 36.

Work Station I

At work station I at angular position P17, an apparatus is provided for straightening the first lamp lead wire 32 and exerting a downward pull on the resistor body 45 to test the physical strength of weld 43. If the weld 43 is acceptable, lamp 12 has the appearance shown in FIG. 30 when it leaves work station G. If the weld 43 is faulty it will break and the resistor 35 will be pulled off of lamp 12.

Figure 47:
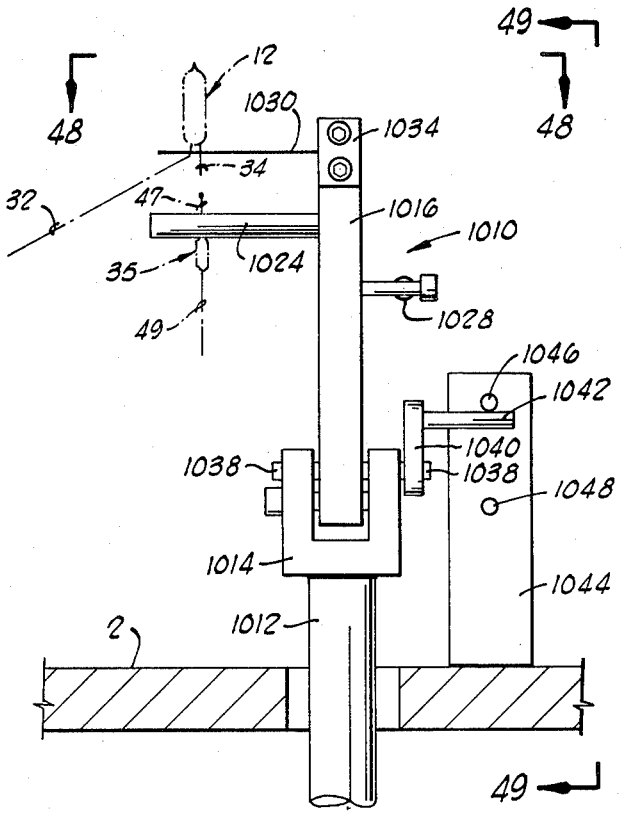
FIG. 47 is an outer elevation view of a weld testing apparatus located at work station I at angular position P17.

In FIG. 47 an outer elevation view is shown of a weld testing apparatus 1010. A vertically reciprocable rod 1012 extends upward through table frame 2, and has a U-shaped bracket 1014 attached to its upper end.

Figure 48:
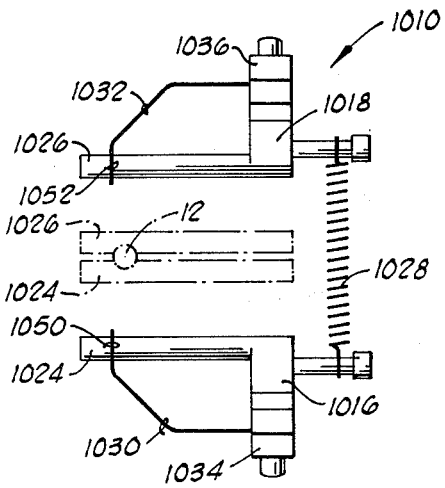
FIG. 48 is a plan view along line 48—48 of FIG. 47.
Figure 49:
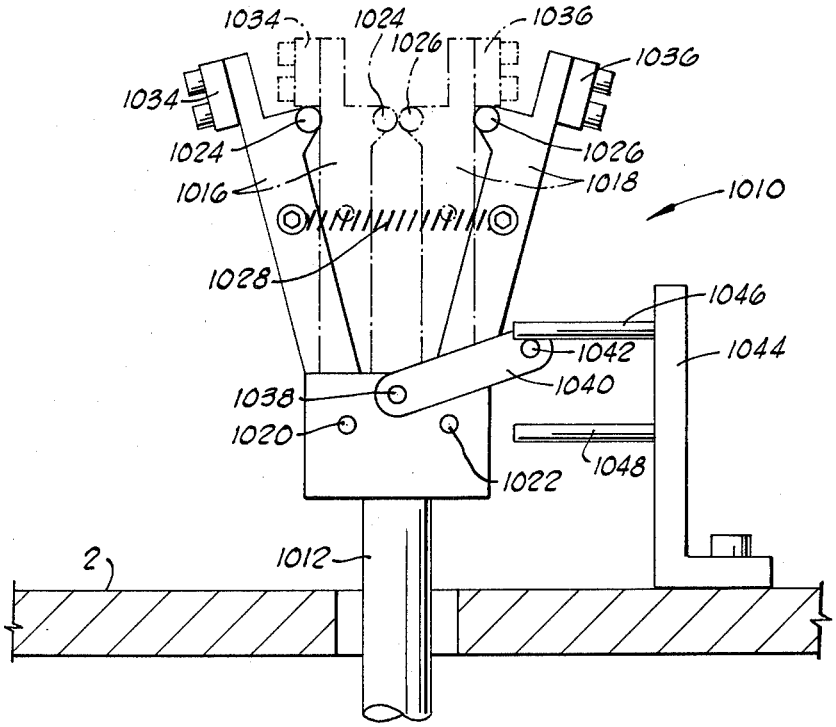
FIG. 49 is a front elevation view along line 49—49 of FIG. 47.

A plan view and a rear elevation view of testing apparatus 1010 are shown in FIGS. 48 and 49, respectively.

Two vertical arms 1016 and 1018 are pivotally attached to bracket 1014 by pins 1020 and 1022, respectively. Extending horizontally forward from arms 1016 and 1018 are cylindrical bars 1024 and 1026. Arms 1016 and 1018 are biased toward each other by tension spring 1028.

Upper ends of arms 1016 and 1018 have wires 1030 and 1032 clamped thereto by clamping plates 1034 and 1036.

A camshaft 1038 extends through bracket 1014 between arms 1016 and 1018 and has a cam (not shown) thereon for spreading arms 1016 and 1018 upon rotation of camshaft 1038. An actuating arm 1040 is attached to camshaft 1038 and has an actuating pin 1042 extending horizontally therefrom.

As seen in FIG. 49 a post 1044 is attached to table frame 2 and has upper and lower limit pins 1046 and 1048 extending horizontally therefrom above and below actuating pin 1042.

When a lamp 12 is first carried to angular position P17 it is located and shaped as shown in phantom lines in FIG. 47. The testing apparatus 1010 is at a position lower than that shown in FIG. 47 and the arms 1016 and 1018 are spread apart as shown in solid lines 48. Arms 1016 and 1018 are spread because actuating pin 1042 is engaged with lower limit pin 1048 thereby camming the arms apart when testing apparatus 1010 is at its lowest position relative to table frame 2.

Then rod 1012 moves upward to the position shown in FIGS. 47 and 49. Actuating pin 1042 engages upper limit pin 1046 flipping arm 1040 downward and allowing spring 1028 to pull arms 1016 and 1018 together to the position shown in phantom lines in FIGS. 48 and 49, with bars 1024 and 1026 clamped on opposite sides of upper lead wire 47 above the body of resistor 35. Outer ends 1050 and 1052 of wires 1030 and 1032 cross above first lead wire 32 of lamp 12.

Then rod 1012 moves downward and the bars 1024 and 1026 pull down on the body of resistor 35. If the weld 43 is good the bars 1024 and 1026 slip over the resistor body when spring 1028 is stretched. If the weld 43 is not good it breaks. During this downward movement of rod 1012 the outer ends 1050 and 1052 of wires 1030 and 1032 bend first lead wire 32 to a substantially vertical position as shown in FIG. 30.

Work Station J

At work station J at angular position P19 a pair of arms similar to arms 712 and 714 of FIG. 35 engage actuating collar 464 of cam sleeve 456 from below and move cam sleeve 456 upward relative to center rod 404 thereby allowing fingers 422, 428 and 430 to expand releasing finished lamp 12 and allowing it to drop down a discharge chute (not shown).

Lamp holder 7 then indexes through positions P20–P24 back to position P1 where the process starts over. At position P24 a safety sensor checks to be sure the lamp 12 was released from holder 7 at prior position P19.

Drive Mechanism

All the various components at positions P1–P24 described above are driven from a single main camshaft in a coordinated manner as is well known to those skilled in the art.

An electric motor is connected by V-belts to a 90° gear box which drives shaft 4. A power take-off from the gear box drives the main camshaft.

Thus it is seen that the automated welding systems and methods of the present invention are readily adapted to achieve the ends and advantages mentioned as well as those inherent therein. While certain specific embodiments of the invention have been illustrated for purposes of the present disclosure, numerous changes in the arrangement and construction of parts may be made by those skilled in the art, which changes are encompassed within the scope and spirit of the present invention as defined by the appended claims.

What is claimed is:

1. An automated method of welding resistors to lamps, said method comprising the steps of:

(a) placing each of a plurality of lamps, each of said lamps including a bulb with first and second lamp lead wires extending therefrom, between a pair of rotating rollers so that said bulb of each of said lamps is engaged by both of said rollers thereby mechanically orienting each of said lamps so that a longitudinal axis of each of said bulbs is substantially vertical and so that each of said bulbs is oriented substantially identically about said longitudinal axis so that said lamps may be received by a lamp holder;

(b) feeding said oriented lamps to a first position of an automated welding system;

(c) receiving one of said oriented lamps in said lamp holder at said first position;

(d) moving said lamp holder and said one lamp to an intermediate position of said automated welding system between said first position and a subsequent position;

(e) cutting one of said lamp lead wires of said one lamp to a predetermined length, while said one lamp is held at said intermediate position by said lamp holder;

(f) moving said lamp holder and said one lamp to said subsequent position of said automated welding system; and (g) welding a resistor lead wire of one of said resistors to said cut one of said lamp lead wires of said one lamp while said one lamp is held at said subsequent position by said lamp holder.

2. The method of claim 1, further comprising:

prior to said step (e), separating said one of said lamp lead wires from the other of said lamp lead wires while said one lamp is held at said intermediate position by said lamp holder.

3. The method of claim 2, wherein:

said separating step is further characterized as inserting a separator blade having a first shearing edge thereon between said first and second lead wires of said one lamp thereby separating said first and second lead wires.

4. The method of claim 3, wherein said cutting step comprises:

after said separating step, moving said one lamp relative to said separator blade to a relative position such that said first shearing edge of said separator blade is adjacent a point at which said one of said lamp lead wires to be welded to said resistor lead wire is to be cut; and moving a cutter means having a second shearing edge thereon from a first position wherein said one lead wire to be cut is located between said first and second shearing edges to a second position, such that said second shearing edge passes across said first shearing edge when it moves from said first position to said second position, thereby cutting said one lead wire between said first and second shearing edges.

5. The method of claim 4, further comprising:

subsequent to said step (g), moving said lamp holder and said one lamp to another position of said automated welding system; and loading said weld in tension to test the physical strength of said weld.

6. The method of claim 5, further comprising:

subsequent to said loading step, moving said lamp holder and said one lamp to a final position thereof relative to said automated welding system; and releasing said one lamp from said lamp holder while said lamp holder is at said final position.

7. The method of claim 6, further comprising:

after said releasing step, returning said lamp holder to said first position to receive another lamp.

8. The method of claim 1, further comprising:

prior to said step (g) and after said step (e), moving said lamp holder and said one lamp to another intermediate position of said automated welding system; and straightening said cut one lamp lead wire and bending the other of said lamp lead wires away from said cut one lamp lead wire, while said one lamp is held at said other intermediate position by said lamp holder.

9. The method of claim 1, further comprising:

subsequent to said step (g), moving said lamp holder and said one lamp to another position of said automated welding system; and loading said weld in tension to test the physical strength of said weld.

10. The method of claim 1, further comprising:

subsequent to said step (g), moving said lamp holder and said one lamp to a final position thereof relative to said automated welding system; and releasing said one lamp from said lamp holder while said lamp holder is at said final position.

11. The method of claim 10, further comprising:

after said releasing step, returning said lamp holder to said first position to receive another lamp.

12. The method of claim 1, wherein:

said feeding step is further characterized as gravity feeding said oriented lamps sequentially along a predetermined path between said rotating rollers.

13. The method of claim 12, further comprising:

releasably retaining each of said lamps at said first position.

14. The method of claim 12, wherein:

said gravity feeding step is further characterized as feeding said oriented lamps sequentially toward small ends of said rotating rollers, said rotating rollers being continuously conically tapered between a location thereon where said lamps are initially placed and said small ends.

15. The method of claim 1, wherein said receiving step comprises:

locating a lamp receiving means of said lamp holder above said one lamp when said one lamp is positioned at said first position;

opening said lamp receiving means so that said one lamp may be received therein;

moving said open lamp receiving means downward toward said one lamp so that said one lamp is received therein; and closing said lamp receiving means to releasably hold said one lamp therein in a fixed position relative thereto.

16. The method of claims 1, 2, 3, 4, 5, 6, 7, 8, 9, 10, 11, 12, 13, 14, or 15 further comprising:

subsequent to said step (c), receiving additional lamps in additional lamp holders, one at a time, at said first position of said automated welding system; and repeating each of said steps which were performed on said one lamp after step (c) on each of said other lamps, so that the steps of said method after step (c) are being simultaneously performed upon a plurality of lamps.

17. An automated method of welding lead wires of first electrical components to lead wires of second electrical components, comprising:

(a) mechanically positioning in sequence at a first predetermined position a plurality of said first electrical components of the type including:

a body;

a lower body portion extending from said body in a direction parallel to a first axis of said body, said lower body portion having a width in a direction parallel to a second axis of said body, and a thickness less than said width in a direction parallel to a third axis of said body, said first, second and third body axes being mutually perpendicular; and first and second lead wires extending from said lower body portion substantially parallel to said first body axis and spaced apart in a direction parallel to said second axis;

said positioning step including the steps of:

orienting each of said electrical components so that said first body axis thereof is vertical, with said lead wires extending downward from said body, and so that said second body axis is parallel to a predetermined horizontal line; and feeding said oriented electrical components to a predetermined location in space;

said first predetermined position of said electrical components corresponding to a first position of an automated welding system and being defined by said predetermined location in space, said vertical orientation of said first body axes, and said orientation of said second body axes parallel to said predetermined horizontal line;

(b) receiving said bodies of said first electrical components sequentially one at a time in a component holder means when said bodies are positioned at said predetermined position;

(c) releasably holding each of said bodies of said first electrical components in said component holder means in a fixed position relative to said component holder means;

(d) moving said component holder means, with each of said first electrical components held therein, from said first predetermined position to a subsequent predetermined position; and (e) welding a lead wire of one of said second electrical components to one of said lead wires of each of said first electrical components, while each of said first electrical components is held at said subsequent predetermined position by said component holder means.

18. The method of claim 17, further comprising:

between said steps (c) and (d), moving said component holder means and each of said first components to an intermediate position between said first position and said subsequent position; and cutting said one lead wire to each of said first components to be welded to said lead wire of said second components to a predetermined length, while each of said first components is held at said intermediate position by said component holder means.

19. The method of claim 18, further comprising:

prior to said cutting step, separating said one of said lead wires of each of said first components from the other of said lead wires of each of said first components while each of said first components is held at said intermediate position by said component holder means.

20. The method of claim 19, wherein:

said separating step is further characterized as inserting a separator blade having a first shearing edge thereon between said first and second lead wires of each of said first components thereby separating said first and second lead wires.

21. The method of claim 20, wherein said cutting step comprises:

after said separating step, moving each of said first components relative to said separator blade to a relative position such that said first shearing edge of said separator blade is adjacent a point at which said one of said lead wires of each of said first components to be welded to said lead wire of said second component is to be cut; and moving a cutter means, having a second shearing edge thereon from a first position wherein said one lead wire of each of said first components to be cut is located between said first and second shearing edges to a second position, such that said second shearing edge passes across said first shearing edge when it moves from said first position to said second position thereby cutting said one lead wire of each of said first components between said first and second shearing edges.

22. The method of claim 21, further comprising:

subsequent to said step (e), moving said component holder means and said each of said first components to another position of said automated welding system; and loading said weld in tension to test the physical strength of said weld.

23. The method of claim 22, further comprising:

subsequent to said loading step, moving said component holder means and each of said first components to a final position thereof relative to said automated welding system; and releasing each of said first components from said component holder means while said component holder means is at said final position.

24. The method of claim 23, further comprising:

after said releasing step, returning said component holder means to said first position to receive another of said first components.

25. The method of claim 17, further comprising:

subsequent to said step (e), moving said component holder means and said each of said first components to another position of said automated welding system; and loading said weld in tension to test the physical strength of said weld.

26. The method of claim 17, further comprising:

subsequent to said step (e), moving said component holder means and each of said first components to a final position thereof relative to said automated welding system; and releasing each of said first components from said component holder means while said component holder means is at said final position.

27. The method of claim 26, further comprising:

after said releasing step, returning said component holder means to said first position to receive another of said first components.

28. The method of claim 17, wherein:

said orienting step is further characterized as placing each of said first components between a pair of rotating rollers so that said bodies of each of said first components is engaged by both of said rollers.

29. The method of claim 28, wherein:

said feeding step is further characterized as gravity feeding said oreinted first components sequentially along a predetermined path between said rotating rollers.

30. The method of claim 29, further comprising:

releasably retaining each of said first components at said first predetermined position.

31. The method of claim 29, wherein:

said gravity feeding step is further characterized as feeding said oriented first components sequentially toward small ends of said rotating rollers, said rotating rollers being continuously conically tapered between a location thereon where said first components are initially placed and said small ends.

32. The method of claim 28, wherein said receiving step comprises:

locating a component receiving means of said component holder means above each of said first components when said first components are positioned at said first position;

opening said component receiving means so that each of said first components may be received therein;

moving said open component receiving means downward toward each of said first components so that said each of said first components is received therein; and closing said component receiving means to releasably hold each of said first components therein in a fixed position relative thereto.

33. The method of claim 17, wherein said receiving step comprises:

locating a component receiving means of said component holder means above each of said first components when said first components are positioned at said first position;

opening said component receiving means so that each of said first components may be received therein;

moving said open component receiving means downward toward each of said first components so that said each of said first components is received therein; and closing said component receiving means to releasably hold each of said first components therein in a fixed position relative thereto.

34. An automated welding system, comprising:

a frame;

a lamp holder;

indexing means, operably associated with said frame and said lamp holder, for moving said lamp holder in successive steps to a plurality of positions relative to said frame;

positioning means for orienting a plurality of lamps, each of said lamps including a bulb with first and second lamp lead wires extending from one end thereof, so that said lamps may be received by said lamp holder, and for feeding said oriented lamps to a first one of said plurality of positions, said positioning means including a pair of rotating rollers arranged and constructed so that said bulb of each of said lamps is engaged by both of said rollers;

actuating means for actuating said lamp holder, when said lamp holder is located at said first position, so that one of said lamps is received by said lamp holder from said positioning means;

a welding means, located at a subsequent one of said plurality of positions, for welding a resistor lead wire of a resistor to one of said lamp lead wires of each of said lamps when said lamp holder is located at said subsequent position; and cutter means, located at an intermediate position of said automated welding system between said first position and said welding means, for cutting said one of said lamp lead wires to be welded to said resistor lead wire to a predetermined length.

35. The system of claim 34, wherein:

said cutter means includes a separator means for separating said one of said lamp lead wires to be cut from the other of said lamp lead wires.

36. The system of claim 35, wherein:

said separator means includes a separator blade having a first shearing edge thereon, and said cutter means includes a second shearing edge movable relative to said first shearing edge for cutting said one lamp lead wire between said first and second shearing edges.

37. The system of claim 35, further comprising:

load means, located at another of said plurality of positions relative to said frame and beyond said position at which said welding means is located, for loading a weld between said one lamp lead wire and said resistor lead wire to test the physical strength of said weld.

38. The system of claim 37, further comprising:

releasing means, located at another of said plurality of positions relative to said frame and beyond said position at which said load means is located, for releasing said lamp from said lamp holder.

39. The system of claim 34, wherein:

said positioning means is further characterized in that said pair of rotating rollers rotates in opposite directions and inwardly from above toward each other.

40. The system of claim 34, wherein:

said rollers have a polished surface for slidingly engaging said bulbs of said lamps.

41. The system of claim 34, wherein:

innermost edges of said rollers are oriented parallel to each other and are separated by a distance less than a greatest minimum cross-sectional dimension of said bulbs of said lamps so that said bulbs rest on top of said rollers with said lead wires extending downward between said rollers.

42. The system of claim 34, wherein:

said feeding function of said positioning means is provided by an orientation of said rotating rollers such that a line of contact between the bulb of one of said lamps and one of said rotating rollers slopes downward from a part of said rollers where said bulb of said lamp initially contacts said rollers toward said first position relative to said frame.

43. The system of claim 34, wherein:

said rollers are tapered rollers, each of said rollers tapering from a large end to a small end, said first position relative to said frame being adjacent and between said small ends of said rollers.

44. The system of claim 43, further comprising:

releasable retaining means for releasably retaining each of said lamps at said first position.

45. An automated welding system, comprising:

a frame;

a component holder means;

indexing means, operably associated with said frame and said component holder means, for moving said component holder means in successive steps to a plurality of positions relative to said frame;

a plurality of initially randomly oriented first electrical components of the type including:

a body;

a lower body portion extending from said body in a direction parallel to a first axis of said body, said lower body portion having a width in a direction parallel to a second axis of said body, and a thickness less than said width in a direction parallel to a third axis of said body, said first, second and third body axes being mutually perpendicular; and first and second lead wires extending from said lower body portion substantially parallel to said first body axis and spaced apart in a direction parallel to said second axis;

positioning means for mechanically positioning said plurality of first electrical components in sequence at a first one of said plurality of positions relative to said frame, said positioning means including:

orienting means for orienting each of said first electrical components so that said first body axis thereof is vertical, with said lead wires extending downward from said body, and so that said second body axis is parallel to a predetermined horizontal line; and feeder means for feeding said oriented first electrical components to a predetermined location in space; wherein said first position of said first electrical components relative to said frame is defined by said predetermined location in space, said vertical orientation of said first body axes, and said orientation of said second body axes parallel to said predetermined horizontal line; and further including:

actuating means for actuating said component holder means when said component holder means is located at said first position, so that one of said first components is received in said component holder means from said positioning means; and a welding means, located at a subsequent one of said plurality of positions, for welding a lead wire of a second electrical component to one of said lead wires of each of said first electrical components when said component holder means is located at said subsequent position.

46. The system of claim 45, further comprising:

cutter means, located at an intermediate position of said automated welding system between said first position and said welding means, for cutting said one of said first component lead wires to be welded to said lead wire of said second component to a predetermined length.

47. The system of claim 46 wherein:

said cutter means includes a separator means for separating said one of said first component lead wires to be cut from the other of said first component lead wires.

48. The system of claim 47, wherein:

said separator means includes a separator blade having a first shearing edge thereon, and said cutter means includes a second shearing edge movable relative to said first shearing edge for cutting said one first component lead wire between said first and second shearing edges.

49. The system of claim 46, further comprising:

load means, located at another of said plurality of positions relative to said frame and beyond said position at which said welding means is located, for loading a weld between said one first component lead wire and said second component lead wire to test the physical strength of said weld.

50. The system of claim 49, further comprising:

releasing means, located at another of said plurality of positions relative to said frame and beyond said position at which said load means is located, for releasing said first electrical component from said component holder means.

51. The system of claim 45, wherein:

said orienting means includes a pair of rotating rollers arranged and constructed so that said body of each of said first electrical components is engaged by both of said rollers.

52. The system of claim 51, wherein:

said orienting means is further characterized in that said pair of rotating rollers rotate in opposite directions and inwardly from above toward each other.

53. The system of claim 51, wherein:

said rollers have a polished surface for slidingly engaging said bodies of said first electrical components.

54. The system of claim 51, wherein:

innermost edges of said rollers are oriented parallel to each other and are separated by a distance less than a greatest minimum cross-sectional dimension of said bodies of said first electrical components so that said bodies rest on top of said rollers with said lead wires extending downward between said rollers.

55. The system of claim 51, wherein:

said feeder means is provided by an orientation of said rotating rollers such that a line of contact between the body of one of said first electrical components and one of said rotating rollers slopes downward from a part of said rollers where said body of said first electrical component initially contacts said rollers toward said predetermined location in space.

56. The system of claim 55, wherein:

said rollers are tapered rollers, each of said rollers tapering from a large end to a small end, said predetermined location in space being adjacent and between said small ends of said rollers.

57. The system of claim 56, further comprising:

releasable retaining means for releasably retaining each of said first electrical components at said predetermined location in space.

* * * * *